US008421603B2

(12) United States Patent
Murakoshi

(10) Patent No.: US 8,421,603 B2
(45) Date of Patent: Apr. 16, 2013

(54) ELECTRONIC APPARATUS AND METHOD AND PROGRAM OF CONTROLLING ELECTRONIC APPARATUS

(75) Inventor: Sho Murakoshi, Tokyo (JP)

(73) Assignee: Sony Corporation, Tokyo (JP)

( * ) Notice: Subject to any disclaimer, the term of this patent is extended or adjusted under 35 U.S.C. 154(b) by 306 days.

(21) Appl. No.: 12/571,756

(22) Filed: Oct. 1, 2009

(65) Prior Publication Data

US 2010/0085208 A1 Apr. 8, 2010

(30) Foreign Application Priority Data

Oct. 3, 2008 (JP) ..... 2008-257975

(51) Int. Cl.
*G08B 5/22* (2006.01)

(52) U.S. Cl.
USPC ..... 340/12.22; 341/176

(58) Field of Classification Search ..... 341/176.2; 178/18.06; 348/734; 358/93; 340/12.22
See application file for complete search history.

(56) References Cited

U.S. PATENT DOCUMENTS

| | | | | |
|---|---|---|---|---|
| 4,989,081 | A * | 1/1991 | Miyagawa et al. | 348/61 |
| 5,237,327 | A * | 8/1993 | Saitoh et al. | 341/176 |
| 5,508,703 | A * | 4/1996 | Okamura et al. | 341/176 |
| 6,215,417 | B1 * | 4/2001 | Krass et al. | 341/20 |
| 2007/0146193 | A1 * | 6/2007 | Sato et al. | 341/176 |
| 2008/0302582 | A1 * | 12/2008 | Sekhri et al. | 178/18.06 |

FOREIGN PATENT DOCUMENTS

| | | | |
|---|---|---|---|
| JP | 2002-247670 | A | 8/2002 |
| JP | 2005-328379 | A | 11/2005 |
| JP | 2007-058569 | A | 3/2007 |
| JP | 2007-158792 | A | 6/2007 |
| JP | 2007-174220 | A | 7/2007 |
| JP | 2007-272500 | | 10/2007 |

* cited by examiner

*Primary Examiner* — Albert Wong
*Assistant Examiner* — Kaleria Knox
(74) *Attorney, Agent, or Firm* — Wolf, Greenfield & Sacks, P.C.

(57) ABSTRACT

An electronic apparatus is designed so that a change in state of the operation key leads to a predetermined processing operation. In the electronic apparatus, a first detector detects operation keys being touched among a plurality of operation keys. A second detector detects an operation key being subjected to an operation of changing the state thereof among the operation keys. A device of notification signal generation generates a notification signal for providing the user with an explanation about processing corresponding to the operation key currently touched based on a detection result of the first detector. A first control device brings a hardware module and/or a software module, which corresponds to the operation key subjected to the change of the state thereof to an operation of changing a state is performed, into an execution state. The operation keys may be formed on a remote control transmitter.

28 Claims, 25 Drawing Sheets

| PRIORITY | PROCESSING PROCESS |
|---|---|
| 1 | NORMAL REPRODUCTION |
| 2 | USER INPUT |
| ⋮ | |
| m | REPEAT REPRODUCTION |

| PRIORITY | PROCESSING PROCESS |
|---|---|
| 1 | REPEAT REPRODUCTION |
| 2 | NORMAL REPRODUCTION |
| 3 | USER INPUT |
| | |
| | |

ELECTRONIC APPARATUS AND METHOD AND PROGRAM OF CONTROLLING ELECTRONIC APPARATUS

BACKGROUND OF THE INVENTION

1. Field of the Invention

The present invention relates to an electronic apparatus to be functioned under control of an operation input entered by a user through a wired or wireless remote-control signal transmitter or user operation input through an operation input unit mounted on the electronic apparatus. The present invention also relates to a method of controlling such an electronic apparatus. The present invention further relates to a program used for performing such a method in the electronic apparatus.

2. Description of the Related Art

An electronic apparatus discriminates an operation key among a plurality of operation keys mounted on a remote-control signal transmitter (hereinafter, also referred to as a remote-control transmitter) when the operation key is depressed by the user to control processing for processing operation (or process function, hereinafter the same will apply). For example, when the electronic apparatus is a player, depression of a play key starts to play a sound truck or the like. The play is stopped upon depression of a stop key during the play.

Here, differences in operation of such operation keys are generally recognized after depressing an operation key and executing the startup control processing of the corresponding processing operation. In some cases, small-size characters are arranged near the corresponding operation key to represent the use of the key. However, the meanings of words represented by the small characters may be hardly recognized by a user.

An example of a method for preventing the user from incorrectly inputting with such an operation key is disclosed in Japanese Published Patent Application No. 2007-272500.

In this patent document, display items, such as symbols, figures, and characters, corresponding to the respective operation keys to be depressed are continuously displayed on a display screen. In addition, each of the operation keys is provided with a sensor that detects a touch thereon. If the sensor detects that the operation key is touched, then the corresponding display item is highlighted to distinguish itself from other display items.

Therefore, even without actually depressing an operation key, the user may touch the operation key to highlight the corresponding display item. Thus, the user finds that the touched operation key is the desired one or not. Therefore, the user is prevented from incorrectly inputting.

However, according to the method of the above patent document, the display screen is obliged to continuously display the display items corresponding to a plurality of operation keys. Thus, the display screen is limited to a particular use, such as a manipulation screen with operation keys. In other words, as described in the paragraph of the above patent document, the use of such a method is limited to a vending machine or the like where key switches correspond to the respective commercial products and display items are also provided for recognizing the respective commercial products.

Furthermore, in the method of the above patent document, any of display items corresponding to the respective operation keys is highlighted upon touching to recognize whether the touched operation key is one that the user intends to operate. In other words, such a method is not applicable to the use in which the user is able to recognize what kind of processing operation will be performed when the operation key is depressed.

SUMMARY OF THE INVENTION

It is desirable to allow a user to recognize the contents of a processing operation which will be performed by an operation key before actually depressing it to perform execution operation.

In order to meet the above demand, one of the embodiments of the present invention is an electronic apparatus including a remote-control signal transmitter having a plurality of operation keys and an electronic apparatus body that receives a remote-control signal from the transmitter, which are configured as follows: The transmitter includes a first detector, a second detector, a first remote-control signal generator, a second remote-control signal generator, and a transmitter unit. That is, the first detector is provided for detecting an operation key currently touched among the plurality of operation keys. The second detector is provided for detecting an operation key on which an operation of changing a state is performed. The first remote-control signal generator is provided for generating a first remote-control signal including information for identifying the operation key currently touched based on a detection result of the first detector and information for indicating that the operation key is being touched. The second remote-control signal generator is provided for generating a second remote-control signal including information for identifying the operation key on which an operation of changing a state is performed based on a detection result of the second detector and information for indicating that the state of the operation key is changed. The transmitter unit is provided for transmitting the first remote-control signal from the first remote-control signal generator and the second remote-control signal from the second remote-control signal generator to the electronic apparatus body. The electronic apparatus body includes a receiver unit, an operation-key recognizer unit, a key operation state recognizer unit, a notification signal generator unit, and a control unit. That is, the receiver unit is provided for receiving the first remote-control signal and the second remote-control signal from the remote-control signal transmitter. The operation-key recognizer unit is provided for recognizing information for identifying the operation key from the first remote-control signal or the second remote-control signal received by the receiver unit. The key operation state recognizer unit is provided for recognizing, from the first remote-control signal or the second remote-control signal received by the receiver unit, whether an operation key recognized by the operation-key recognizer unit or whether a state is changed. The notification signal generator unit is provided for generating a notification signal for notifying a user of explanation about a process corresponding to an operation key recognized by the operation-key recognizer unit when the key operation state recognizer unit recognizes that the operation key is touched. The control unit is provided for controlling a hardware module and/or a software module corresponding to the operation key recognized by the operation-key recognizer unit when the key operation state recognizer unit recognizes that the state of the operation key is changed.

In the electronic apparatus according to the embodiment of the present invention, in advance of changing the state of an operation key, such as depression thereof, a first detector is employed to detect a state in which the operation key is being touched by the user. Here, in the state in which the operation key is being touched by the user may consciously touch the operation key to depress the key even though in some cases the user may only touch the operation key without intending to depress the key.

Therefore, in this embodiment, the electronic apparatus deems that the user touching an operation key intends to depress the operation key. Based on this, the transmitter according to the embodiment of the present invention generates a first remote-control signal based on the detection result from the first detector and the first remote-control signal is then transmitted to the electronic apparatus body.

Subsequently, the electronic apparatus body discriminates a remote-control signal received in the device of discrimination. If it is determined that a first remote-control signal is received, a notification signal which notifies the user of a processing operation that corresponds to the operation key currently touched is generated. If the notification signal is a display message, for example, it is displayed on the display screen of a display device and reported to a user what a processing operation corresponding to an operation key is.

Therefore, in advance to carry out execution operation such as depression operation, the user can recognize the kind of processing operation the electronic apparatus performs.

According to any embodiment of the present invention, detecting an operation key being touched allows the electronic apparatus to previously deduce the intent of operation input, such as key depression, which cause a change in state of an operation key. Subsequently, depending on the estimation, the user is reported what a processing operation corresponding to the operation key currently touched is. Therefore, in advance to carry out execution operation such as depression operation, the user can recognize the kind of processing operation the electronic apparatus performs.

BRIEF DESCRIPTION OF THE DRAWINGS

FIG. 2 is a schematic diagram illustrating an exemplary configuration of a remote-control transmitter provided for the electronic apparatus in accordance with the first embodiment of the present invention, where

FIG. 8 is a schematic diagram illustrating examples of process explanation display of the electronic apparatus in accordance with the first embodiment of the present invention, where

DESCRIPTION OF THE PREFERRED EMBODIMENTS

Hereinafter, electronic apparatuses according to the respective embodiments of the present invention will be described with reference to the attached drawings. In some embodiments described below, an operation key is designed so that the state of key operation can be changed by key depression.

A structural component for detecting that the state of key operation has been changed by the user is not limited to one that changes the sate by key depression. Alternatively, the state may be changed by a sliding movement, a see-saw mechanism, or the like.

First Embodiment

Figure 1:
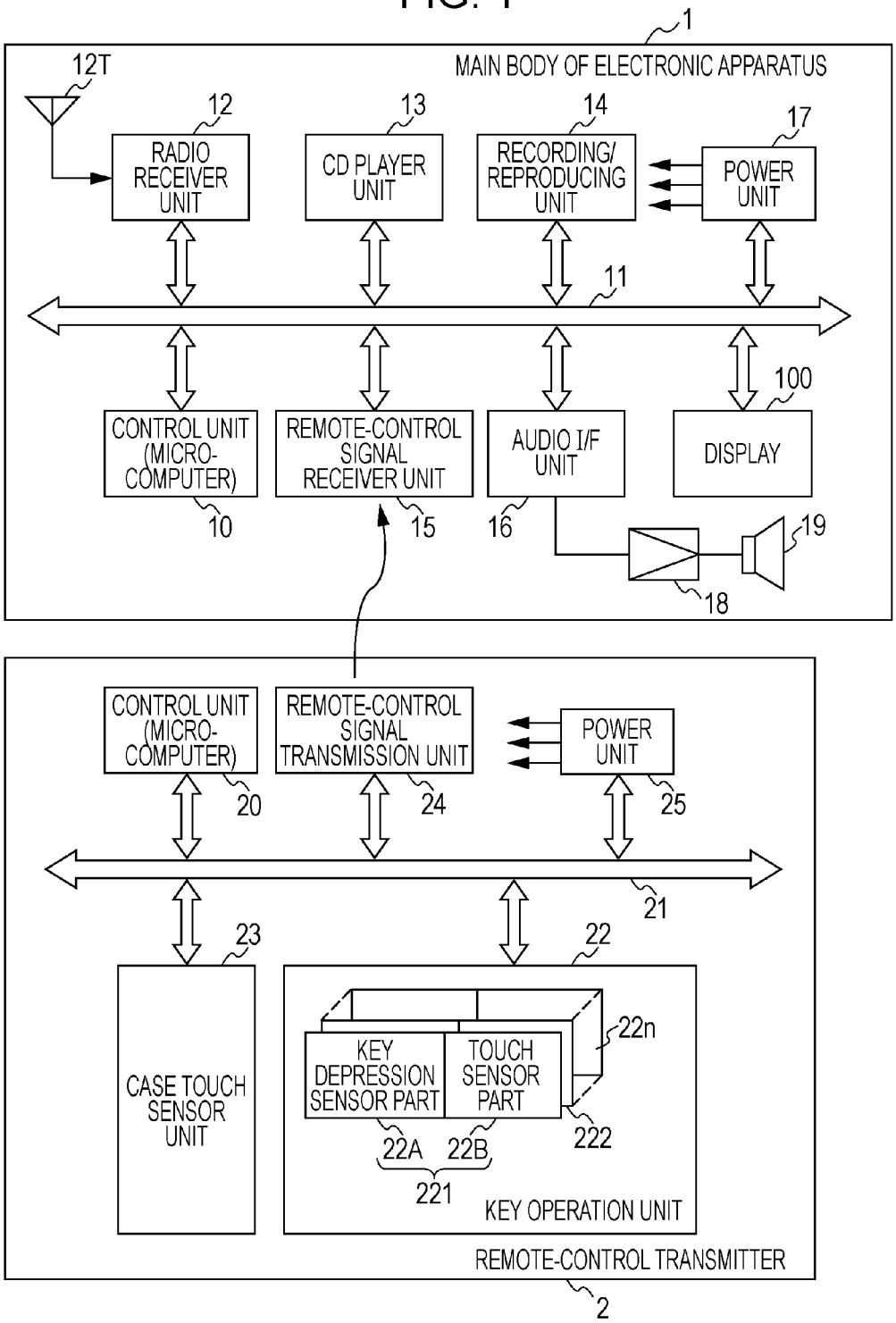
FIG. 1 is a block diagram illustrating an exemplary configuration of an electronic apparatus in accordance with a first embodiment of the present invention.

FIG. 1 illustrates an example of the overall configuration of an electric apparatus according to a first embodiment of the present invention. The electronic apparatus of the first embodiment is a complex electronic apparatus having functions that respectively correspond to the functions of a radio receiver, a compact disc (CD) player, and a recording/reproducing device. The configuration of the electronic apparatus of the first embodiment includes hard modules that carry out the functions of the complex electronic apparatus.

The electronic apparatus of the first embodiment includes the main body of an electronic apparatus (hereinafter, also referred to as an electronic apparatus body) 1 and a transmitter unit for transmitting remote-control signals (hereinafter, referred to as a remote-control transmitter) 2. In the first embodiment, a remote-control signal is transmitted or received without any wire. Alternatively, however, the electronic apparatus body 1 and the remote-control transmitter 2 may be connected to each other through a cable by a wired system.

<Hardware Configuration Example of Electronic Apparatus Body 1>

In the electronic apparatus body 1, a radio receiver unit 12, a CD player unit 13, and a recording/reproducing unit 14 are provided as hardware modules respectively and are connected to system bus 11. To the system bus 11, furthermore, a remote-control signal receiving unit 15, an audio I/F unit 16, a power unit 17, and display 100 are connected. The display 100 may be constructed of a liquid crystal display (LCD) and associated parts thereof.

Furthermore, the system bus 11 is further connected to a control unit 10 that controls the whole electronic apparatus body 1 while controlling each unit connected to the system bus 11. In this example, the control unit 10 includes a microcomputer. In this example, during that the electronic apparatus body 1 is powered ON, supply voltage is applied to the control unit 10.

According to the first embodiment, but not illustrated in detail, each of hardware modules, the power unit 17 is designed to apply supply voltage to each of the hardware modules, the radio receiver unit 12, the CD player unit 13, and the recording/reproducing unit 14, independently from one another. In addition, each of the radio receiver unit 12, the CD player unit 13, and the recording/reproducing unit 14 has the function of waiting to start while allowing the minimum necessary portions thereof to receive supply voltage (i.e., running in standby state).

The LCD of the display 100 is provided with a backlight part (not shown). Supply voltage may be also applied from the power unit 17 to the backlight part under control of the control unit 10. In other words, the control unit 10 may supply the voltage to the backlight part at a previously defined time of making a display brighter to emphasize on a new representation or the like on the display 100.

The control unit 10 is capable of supplying control signals to each of the radio receiver unit 12, the CD player unit 13, the recording/reproducing unit 14, and each part of display 100 via the system bus 11. Thus, under the control of the control unit 10, for example, each of the units is allowed to receive supply voltage and to be switched between the standby state and the running state.

The electronic apparatus of the first embodiment includes a radio-broadcasting receiving mode, a CD playing mode, a radio-broadcasting recording mode, and a CD copy mode. The electronic apparatus further includes other modes, such as a mode for allowing the recording/reproducing unit 14 to reproduce data from a recording medium.

As described later, the control unit 10 analyzes a remote-control signal received by the remote-control signal receiver unit 15 and discriminates whether the remote-control signal is an instruction for any of these modes. Furthermore, depending to the result of the discrimination, the control unit 10 generates a control signal for each of the radio receiver unit 12, the CD player unit 13, the recording/reproducing unit 14, and so on.

The control signal from the control unit 10 sets the radio receiver unit 12 to a running state (executing or operating state) when the radio receiver unit 12 is in radio-broadcasting receiving mode or radio-broadcasting recording mode or set to a stand-by state when in any of other modes.

From signals received via an antenna 12T, the radio receiver unit 12 in running state extracts broadcasting signals of a broadcast program selected by the user on the basis of control signals from the control unit 10 and then demodulates broadcast signals of the broadcast program. Subsequently, the radio receiver unit 12 outputs audio signals of the demodulated broadcasting signals to the system bus 11.

The audio signals transmitted from the radio receiver unit 12 to the system bus 11 are supplied to the audio I/F unit 16 under control of the control unit 10. In this example, supply voltage is applied to the audio I/F unit 16 as long as the electronic apparatus body 1 is powered on.

The audio I/F unit 16 supplies the received audio signals to a loudspeaker 19 through a power amplifier 18. The loudspeaker 19 carries out sound reproduction of audio signals and makes a sound of the reproduced audio.

In the radio-broadcasting recording mode, audio signals transmitted from the radio receiver unit 12 to the system bus 11 are supplied to the recording/reproducing unit 14 under control of the control unit 10. Subsequently, the recording/reproducing unit 14 performs recording of the audio signals on the recording medium. Furthermore, the radio-broadcasting recording mode is initiated upon depression of a recording key on a remote-control transmitter during the state of receiving the radio-broadcasting. Then, the recording/reproducing unit 14 starts to record radio-broadcasting signals from the time of depressing the recording key.

The CD player unit 13 has a CD insert/eject slot (not shown). The CD player unit 13 is in the running state when it is in CD playing mode or CD copy mode and in the stand-by state when it is in any of other modes.

When the CD player unit 13 is in the running state and receiving an instruction of playing CD through the remote-control transmitter 2, the CD player unit 13 reads recorded signals from the CD and then reproduces and decodes audio signals, followed by transmitting the decoded audio signals to the system bus 11.

The audio signals transmitted from the CD player unit 13 to the system bus 11 are supplied to the audio I/F unit 16 under control of the control unit 10. Subsequently, in a manner similar to the radio receiving mode, reproduced sounds are emitted from the loudspeaker 19.

In the CD copying mode, audio signals transmitted from the CD player unit 13 to the system bus 11 are also supplied to the recording/reproducing unit 14 under control of the control unit 10. Subsequently, the recording/reproducing unit 14 performs recording of the audio signals on the recording medium.

When electronic apparatus body 1 is loaded with CD, the CD copy mode is initiated if a CD dubbing key on the remote-control transmitter is depressed. In the electronic apparatus of the present embodiment, even if the recording key is depressed while the CD is playing, the depression of the recording key is nullified. If the CD dubbing key on the remote-control transmitter is depressed, dubbing and recording of all tracks of the CD or previously specified tracks thereof are initiated.

The recording/reproducing unit 14 goes into a running state at the time of a radio-broadcasting recording mode, a CD copy mode, and reproduction mode of an archive medium in recording/reproducing unit 14, while it goes into a stand-by state at the time of a stand-by mode.

The recording/reproducing unit 14 performs recording to a recording medium and reproduction from the recording medium in response to control signals from the control unit 10.

The recording medium may be a disk recording medium, a tape recording medium, or a semiconductor memory. In addition, the recording medium is not limited to a removal type. It may be of a built-in type. If the recording/reproducing unit 14 is designed to use a removal-type recording medium, the recording/reproducing unit 14 is provided with an insert/eject slot. The internal recording media may be a hard disk or a semiconductor memory such as a flash memory. In this embodiment, the recoding medium of the recording/reproducing unit 14 may employ a hard disk.

The recording/reproducing unit 14 in running state performs processing of recording audio signals transmitted through the system bus 11 to a recording medium when and when receiving a recording instruction from the user via the remote-control transmitter 2 (recording mode).

In addition, the recording/reproducing unit 14 in running state reads recorded signals from the recording medium and decodes audio signals when receiving a reproduction instruction from the user via the remote-control transmitter 2 (reproduction mode). Subsequently, the recording/reproducing unit 14 outputs the decoded audio signals to the system bus 11.

In a manner similar to any of other modes, the audio signals transmitted from the recording/reproducing unit 14 to the system bus 11 are supplied to the loudspeaker 19 from the power amplifier 18 through the audio interface 16 to make a sound.

In the first embodiment, the remote-control signal receiving unit 15 receives supply voltage and is in a running state as long as the electronic apparatus body 1 is powered on. In the first embodiment, furthermore, remote-control signals, such as those made of infrared rays, may be received from the remote-control transmitter 2 and then transmitted to the system bus 11. The remote-control signals transmitted to the system bus 11 are analyzed by software in the control unit 10 to generate control signals for controlling the respective units from the control unit 10 as described above. Furthermore, it will be appreciated that remote-control signals transmitted without wire are not limited to infrared rays.

The control process, which has been described above, is provided for depression of the operation key on the remote-control transmitter 2. In this first embodiment, the remote-control transmitter 2 has a function of detecting that the operation key is being touched and a remote-control signal based on such detection is also transmitted. The details of control process carried out by the control unit 10 of the electronic apparatus body 1 when the remote-control signal based on the detection that the operation key is being touched will be described later.

<Hardware Configuration Example of Remote-Control Transmitter 2>

Figure 2A:
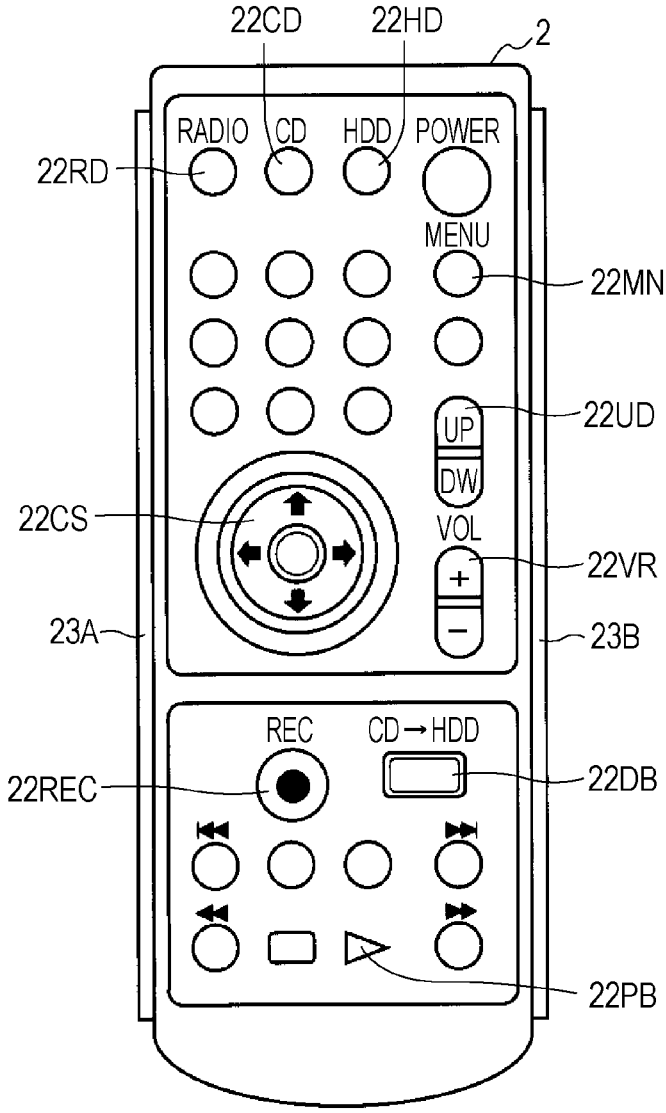
FIG. 2A is a front view of the remote-control transmitter and FIG. 2B is a side view in the width direction thereof.
Figure 2B:
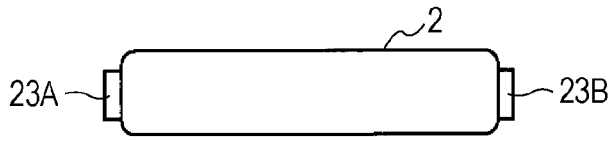

Next, the configuration of the remote-control transmitter 2 will be described with reference to FIG. 2. FIG. 2 is a schematic diagram illustrating an exemplary configuration of the remote-control transmitter 2 according to the present embodiment. FIG. 2A is a front view of the remote-control transmitter 2 viewing from the operation side thereof. FIG. 2B is a side view of the remote-control transmitter 2 viewing from one side in the longitudinal direction thereof.

As shown in FIG. 1, the remote-control transmitter 2 includes a key operation unit 22, a case touch sensor part 23, a remote-control signal transmission unit 24, and a power unit 25, which are connected to a system bus 21. Furthermore, the system bus 21 is further connected to a control unit 20 that controls the whole remote-control transmitter 2 while controlling each unit connected to the system bus 21. In this example, the control unit 20 includes a microcomputer.

The remote-control signal transmission unit 24 is responsible for sending remote-control signals to the electronic apparatus body 1. As mentioned above, in this embodiment, wireless transmission of remote-control signals is performed using infrared rays.

In this embodiment, the remote-control transmitter 2 is designed to be driven by a battery cell. The power source unit 25 generates power voltage to be supplied to each unit from the voltage of the battery cell. When operating an operation key on the remote-control transmitter 2, in general, the user operates the key while holding the case of the remote-control transmitter 2 in hand. When the remote-control transmitter 2 is not held by user, the remote-control transmitter 2 may be considered as a non-operating state.

In this case, the remote-control transmitter 2 of the present embodiment is designed that only the minimum necessary portions thereof are allowed to receive supply voltage to keep the consumption of the battery power supply at the minimum until the user holds the case of the remote-control transmitter 2 in hand.

To determine whether the user holds the case of the remote-control transmitter 2 in hand, it may be determined whether the case of the remote-control transmitter 2 is being touched by the user. In this embodiment, therefore, the remote-control transmitter 2 is provided with a case touch sensor unit 23 that determines whether the user touches the case of the remote-control transmitter 2.

Thus, the remote-control transmitter 2 is designed to constantly apply supply voltage from the power unit 25 to the case touch sensor unit 23 and the control unit 20 to determine whether the user touches the case of the remote-control transmitter 2.

As shown in FIG. 2, for example, the case touch sensor unit 23 may be constructed of two touch sensor elements 23A and 23B on the opposite sides of the case of the remote-control transmitter 2. Each of these touch sensor elements 23A and 23B detects the user's touch thereon and then outputs the result of the detection.

The case touch sensor unit 23 recognizes the user's touch on the housing of the remote-control transmitter 2 as a result of determining whether one or both of the touch sensor elements 23A and 23B have been touched on the basis of the detection outputs from the touch sensor elements 23A and 23B.

If the case touch sensor unit 23 detects that the case is being touched, then it sends out the detection output to the system bus 21.

The control unit 20 observes a detection output from the case touch sensor unit 23. When the control unit 20 detects that the user is touching the case of the remote-control transmitter 2, it determines that the user holds the remote-control transmitter 2 and intends to start a remote-control operation.

Furthermore, when the control unit 20 recognizes that the case of the remote-control transmitter 2 is being touched by the user from the detection result of the case touch sensor unit 23, the power unit 25 is allowed to apply supply voltage to the key operation unit 22 and the remote-control signal transmitter unit 24.

In this embodiment, furthermore, the control unit 20 transmits a remote-control signal that device "power on" from the remote-control signal transmission unit 24 to the electronic apparatus body 1 when the user's touch on the case of the remote-control transmitter 2 is detected. This is because the user intends to remotely control the electronic apparatus body 1 when the user holds the remote-control transmitter 2 in hand. Thus, it is considered that the electronic apparatus body 1, which is target equipment for remote-control, may be powered on and started.

After transmitting a remote-control signal for power-on to the electronic apparatus body 1, the control section 20 will wait for operation of an operation key on a key operation unit 22 by the user.

As shown in FIG. 1, the key operation unit 22 includes a plurality of operation keys 221, 222, . . . , and 22*n* (n is an integer of 2 or more). These operation keys are arranged on the case of the remote-control transmitter 2 as exemplified in FIG. 2.

In this embodiment, as shown in FIG. 1, each of the operation keys 221, 222, . . . , and 22*n* includes a key depression sensor part 22A and a touch sensor part 22B. The Key depression sensor part 22A is an example of a structural component that detects a change in state caused by depression of any of operation keys 221, 222, . . . , and 22*n* by the user. The key depression sensor part 22A employs a switching device or the like to detect a change in state caused by depression of each of operation keys 221, 222, . . . , and 22*n* by the user with a switching device etc. Then, when the depression is detected, the key depression sensor part 22A generates a detection output that represents such a fact of detecting the depression.

The touch sensor part 22B is an example of a structural component that detects user's touch on any of operation keys 221, 222, . . . , and 22*n*. When the touch sensor unit 22B detects the user's touch on any of operation keys 221, 222, . . . , and 22*n*, it generates a detection output represents such a fact of detecting the user's touch. Then, the touch sensor part 22B sends out the detection output for user's touch to the system bus 21.

Figure 3:
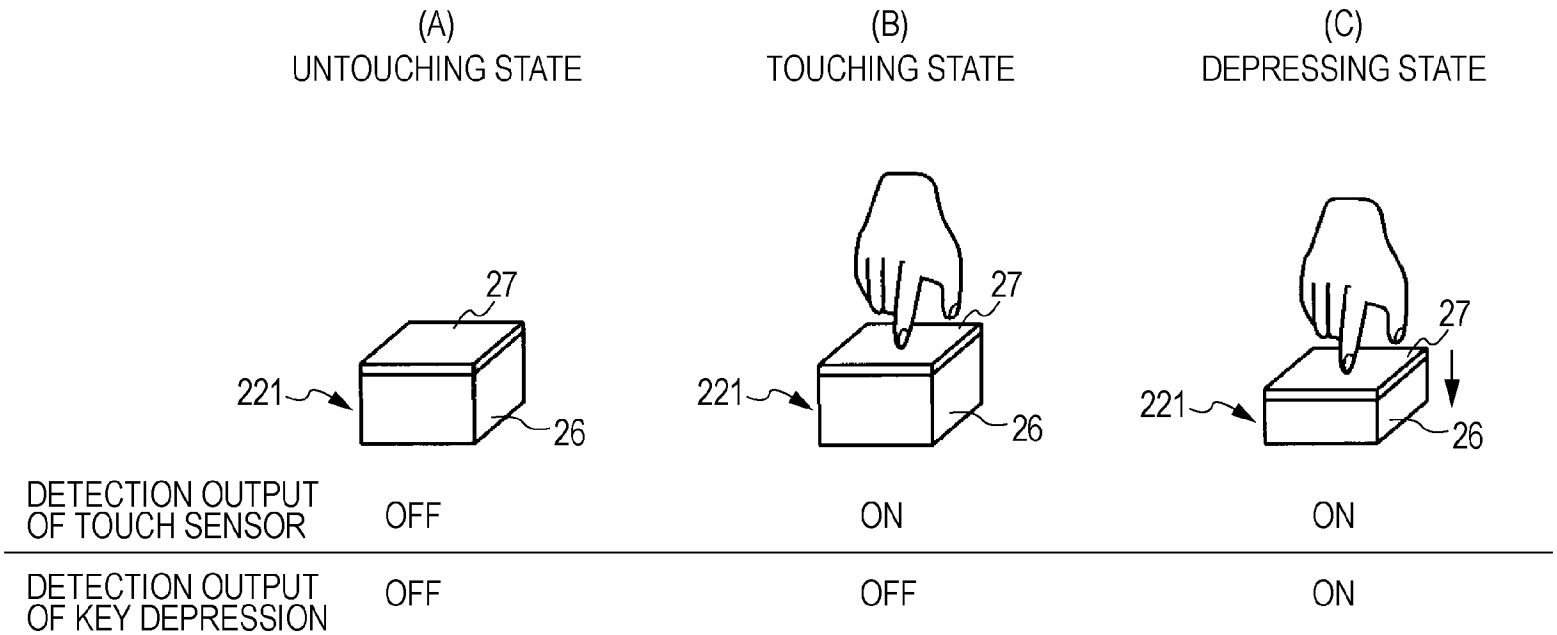
FIG. 3 is a schematic diagram illustrating different operation states of an operation key on the remote-control transmitter provided for the electronic apparatus in accordance with the first embodiment of the present invention.

In this embodiment, each of an operation keys 221, 222, . . . , and 22*n* of this embodiment includes a touch sensor element 27 attached on a depression knob portion 26, such as one shown in FIG. 3 (in this figure, only the operation key 221 is illustrated).

In contrast to the related-art depression key that represents only two states of the key, depressed or not, any of the operation keys 221, 222, . . . , and 22*n* of the present invention represents three states as shown in FIG. 3. In FIG. 3, the operation key 221 is illustrated as a representative of the operation keys 221, 222, . . . , and 22*n*. Specifically, FIG. 3 illustrates three states of an operation key, (A) an untouching state, (B) a touching state, and (C) a depressing state. More specifically, in the figure, the state (A) of the operation key 221 is that the user does not touch on the key and the key is not depressed at all (untouching state). In the untouching stated, the detection output DB of the touch sensor pat 22B is turned "OFF", indicating that the operation key 221 is being untouched. The detection output DA of the key depression sensor part 22A is turned "OFF", indicating that the operation key 221 is being undressed.

Furthermore, in FIG. 3, the state (B) of the operation key 211 is that the user touches the key without depression (touching state). Although the detection output DB of touch sensor part 22B is turned "ON" indicating that the operation key 221 is being touched, the detection output DA of the key depression sensor part 22A is turned "OFF" indicating that the operation key 221 is being undressed.

In FIG. 3, the state (C) of the operation key 221 is that the key is being depressed (depressing state). In this depressing state, the detection output DB of the touch sensor part 22B is turned "ON" indicating that the operation key 221 is being touched, while the detection output DA of the key depression sensor part is turned "ON" indicating that the operation key 221 is being depressed.

When the state of the operation key is changed from the untouching state (A) to the touching state (B) in FIG. 3, the control unit 20 recognizes such a change in state of the operation key from the detection outputs DA and DB. The control unit 20 generates remote-control signals containing information that indicates the user's touch on the operation key and information that indicates the type of the operation key being touched. Then, the control unit 20 transmits the remote-control signals to the electronic apparatus body 1 through the remote-control signal transmission unit 24.

When the state of the operation key is changed from the touching state (B) to the depressing state (C) in FIG. 3, the control unit 20 recognizes such a change in state of the operation key from the detection outputs DA and DB. The control unit 20 generates a remote-control signal containing information that indicates the depression on the operation key and information that indicates the type of the operation key being depressed. Then, the control unit 20 transmits the remote-control signals to the electronic apparatus body 1 through the remote-control signal transmission unit 24.

Furthermore, the remote-control transmitter 2 does not transmit a remote-control signal with respect to the operation key in untouching state (A) in FIG. 3. If the state of the operation key is changed from the untouching state (A) to the touching state (B) in FIG. 3 or from the touching state (B) to the depressing state (C) in FIG. 3, the corresponding remote-control signal is transmitted from the remote-control transmitter 2 to the electric apparatus body 1.

<Functional Block Diagram of Remote-Control Transmitter 2>

Figure 4:
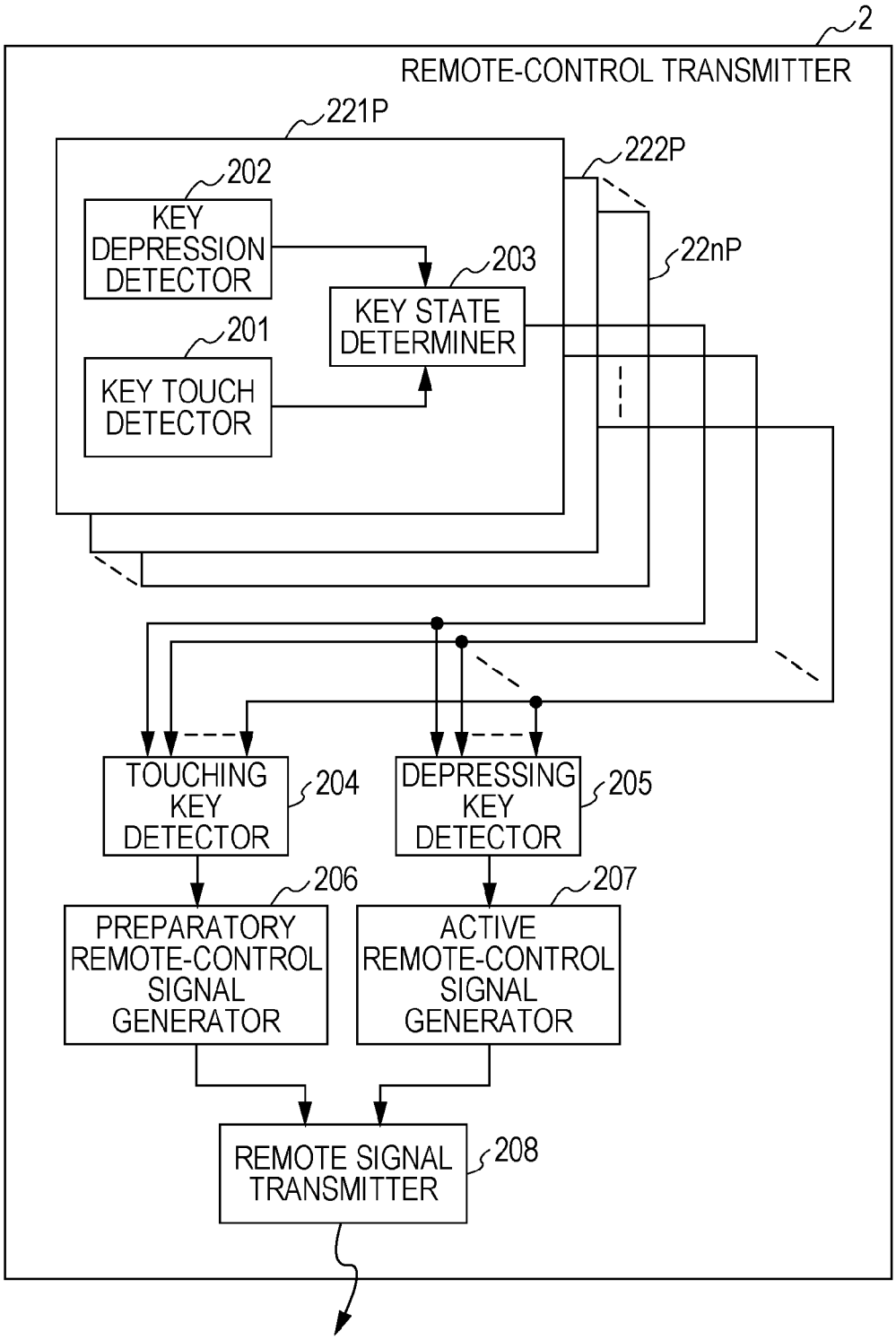
FIG. 4 is a functional block diagram of the remote-control transmitter provided for the electronic apparatus in accordance with the first embodiment of the present invention.

FIG. 4 is a functional block diagram of the remote-control transmitter 2 in mainly consideration of the processing carried out by the control unit 20 of the above remote-control transmitter 2.

As shown in FIG. 4, the control unit 20 includes functional sections 221P, 222P, . . . , and 22*n*P that correspond to the respective operation keys 221, 222, . . . , and 22*n*, and detect the state of the operation key state among the three states shown in FIG. 3. Furthermore, the control unit 20 includes a touching key detector 204, depressing key detector 205, a preparatory remote-control signal generator 206, and an active remote-control signal generator 207. The remote-control transmitter 208 includes the remote-control signal transmission unit 24.

Each of the functional sections 221P, 222P, . . . , and 22*n*P includes a key touch detector 201, a key depression detector 202, and a key state determiner 203.

The key touch detector 201 includes a touch sensor part 22B of each of the operation keys 221, 222, . . . , and 22*n* and a software process carried out in the control unit 20. The key touch detector 201 detects whether the user touches each of the operation keys. When detecting the user's touch on the target operation key, the key touch detector 201 generates a detection output showing such a fact to the key state determiner 203.

The key depression detector 202 includes a key depression sensor part 22A of each of the operation keys 221, 222, . . . , and 22*n* and a software process carried out in the control unit 20. The key depression detector 202 detects whether the user depresses each of the operation keys. When the key depression detector 202 that the target operation key is depressed is detected, it outputs a detection output showing such a fact to the key state determiner 203.

From a detection output from the key touch detector 201 and a detection output from the key depression detector, the key state determiner 203 determines whether the operation key is in any one of three states shown in FIG. 3. The result of the state determination is output. The result of the state determination from this key state determiner 203 is considered as an output of any of the functional sections 221P, 222P, . . . , and 22*n*P.

The outputs from the respective functional sections 221P, 222P, . . . , and 22*n*P, the results of the state determination for the respective operation keys, are supplied to the touching key detector 204 and the depressing key detector 205. In this embodiment, the key state determiner 203, the touching key detector 204, and the depressing key detector 205 are configured as software processing, respectively.

The touching key detector 204 observes the results of the state determination of the operation keys from the respective functional sections 221P, 222P, . . . , and 22*n*P. If there is an operation key currently touched by user, the touching key detector 204 will detect such a fact. The touching key detector 204 may be also referred to as a first detector.

Subsequently, when detecting the operation key currently touched, the touching key detector 204 supplies a key detection output signal, which contains both information that identifies the operation key currently touched and information that the operation key is being touched, to the preparatory remote-control signal generator 206.

When the touching key detector 204 outputs a touching key detection output signal, the preparatory remote-control signal generator 206 generates a preparatory remote-control signal. This preparatory remote-control signal is a control signal that prompts an execution preparatory state. Therefore, when the operation key currently touched is depressed, processing corresponding to the operation key is promptly performed in the electronic apparatus body 1.

This preparatory remote-control signal includes both information that identifies an operation key currently touched and information that the operation key is being touched by the user in the touching key detection output signal. The execution preparatory state and the control thereof will be described later in detail.

When the preparatory remote-control signal generator 206 generates this preparatory remote-control signal, the preparatory remote-control signal is transmitted to the electronic apparatus body 1 through the remote-control transmitter 208.

Therefore, when the user touches any of operation keys 22*i* ("i" denotes a positive number not more than "n"), the key touch detector 201 of the functional section 221P of the operation key 22*i* currently touched detects the user's touch of the key. Subsequently, the key state determiner 203 of the functional section 221P outputs the result of the state determination that indicates the user's touch on the operation key 22*i*.

The touching key detector 204 detects the operation key currently touched and then transmits a touching key detection output signal to the preparatory remote-control signal generator 206. The preparatory remote-control signal generator 206 generates a preparatory remote-control signal based on a touching key detection output signal from the touching key detector 204 and then transmits the preparatory remote-control signal to the electronic apparatus body 1 through remote-control transmitter 208.

Next, depressing key detector 205 observes the result of the state determination of each of operation keys of the respective functional sections 221P, 222P, . . . , and 22*n*P, if there is an operation key currently depressed by the user, the touching key detector 205 will detect such a fact. The depressing key detector 205 corresponds to second detector.

Subsequently, when the depressing key detector 205 detects an operation key currently depressed, the depressing key detector 205 supplies an output signal of depressed key detection, which contains both information that identifies the operation key currently depressed and information that the operation key is being depressed, to the active remote-control signal generator 207.

When an output signal of depressed key detection is output from the depressing key detector 205, the active remote-control signal generator 207 generates an active remote-control signal.

In the electronic apparatus body 1, this active remote-control signal is a control signal that directs the execution of processing corresponding to the depressed operation key. This active remote-control signal includes both the information that identifies the operation key currently depressed in an output signal of depressed key detection and the information that indicates the user's depression of the operation key in the output signal of depressed key detection.

When active remote-control signal generator 207 generates an active remote-control signal, it transmits the active remote-control signal to the electronic apparatus body 1 through the remote-control transmitter 208.

Therefore, when the user depresses any of operation keys 22*i* ("i" denotes a positive number not more than "n"), the key depression is detected by the key depression detector 202 of the functional section 221P of the operation key 22*i* currently depressed. Furthermore, the key state determiner 203 of the functional section 221P outputs the result of the state determination that indicates the user's depression of the operation key 22*i*.

In response to the result of the state determination, the depressing key detector 205 detects a depressed operation key and then transmits an output signal of depressed key detection to the active remote-control signal generator 207. The active remote-control signal generator 207 generates an active remote-control signal based on the output signal of depressed key detection from the depressing key detector 205 and then transmits the active remote-control signal to the electronic apparatus body 1 through the remote-control transmitter 208.

<Functional Block Diagram of Electronic Apparatus Body 1>

Figure 5:
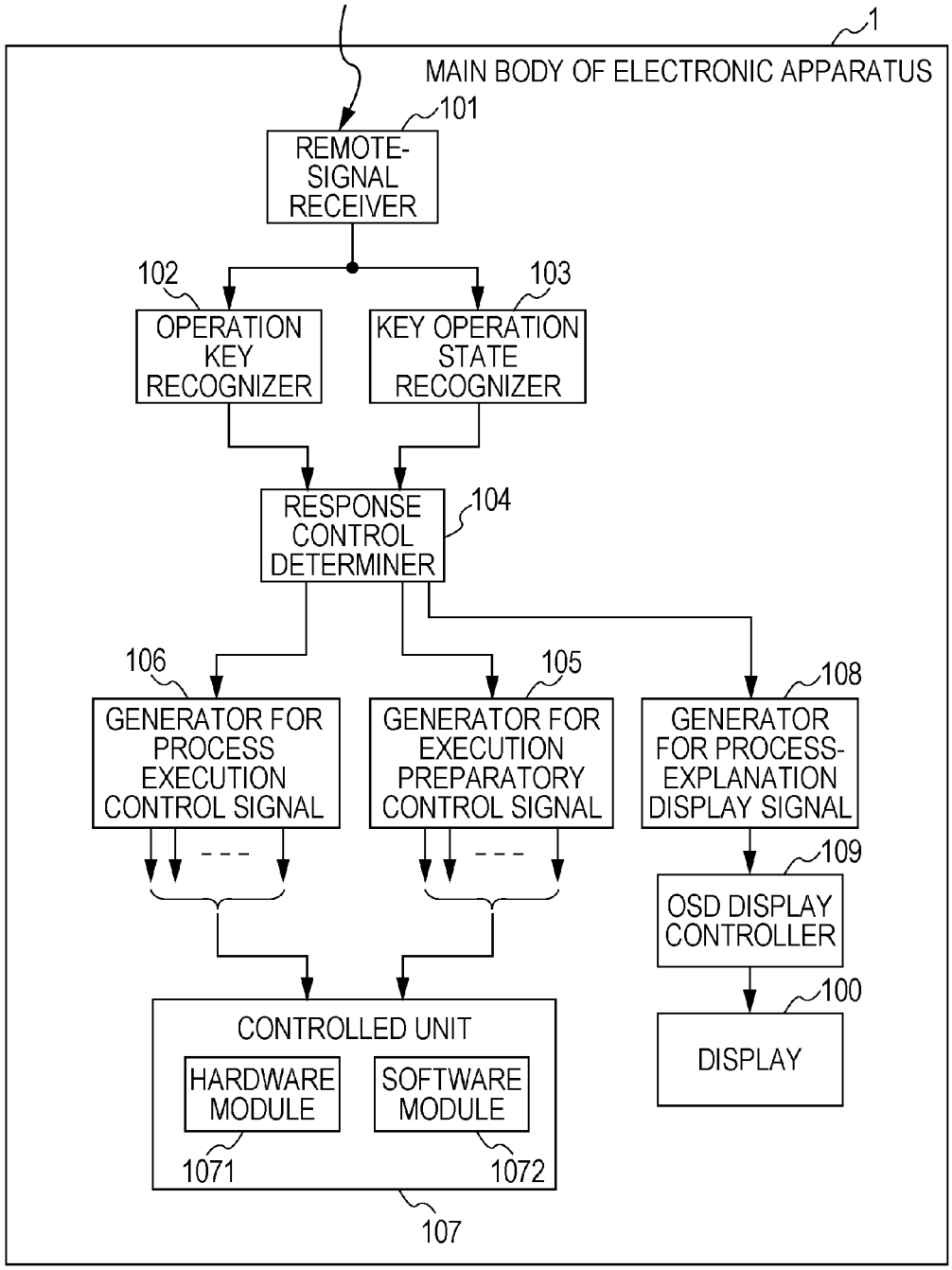
FIG. 5 is a functional block diagram of the electronic apparatus body provided for the electronic apparatus in accordance with the first embodiment of the present invention.
Figure 6:
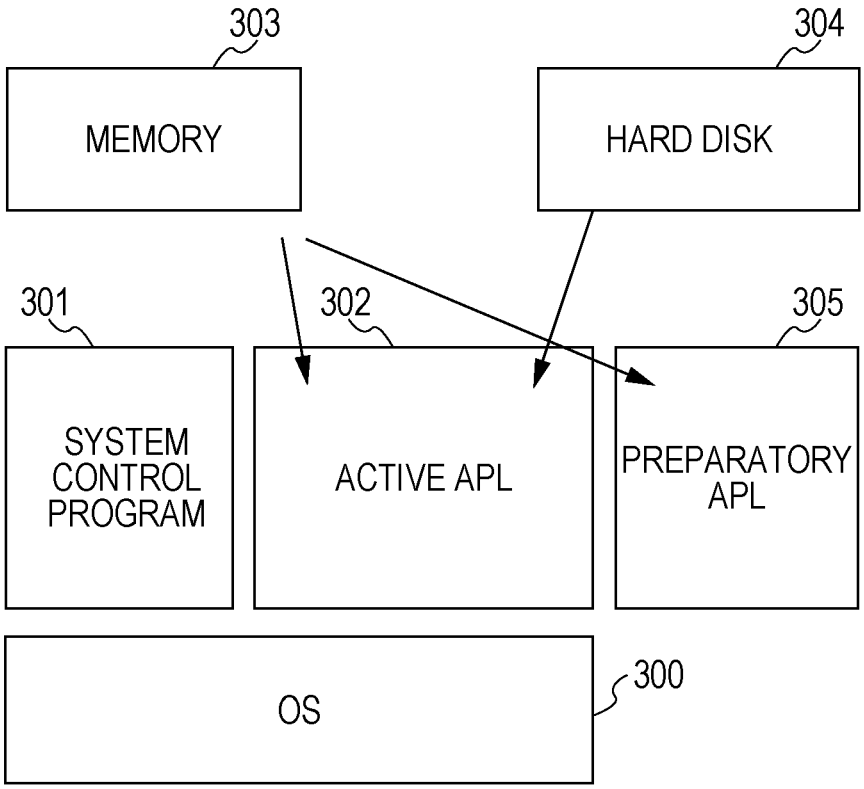
FIG. 6 is a block diagram illustrating an example of execution preparatory control in the electronic apparatus in accordance with the first embodiment of the present invention.

FIG. 5 is a functional block diagram of the electronic apparatus body 1 that has received a remote-control signal, illustrating the receiving and control processing of the remote-control signal. The functional block diagram shown in FIG. 5 mainly illustrates the processing executed by the control unit 10 of the electronic apparatus body 1.

In FIG. 5, the remote-control signal receiver 101 includes a remote-control signal receiving unit 15. In addition, devices, which the control unit 10 executes as functions as software processing, include an operation key recognizer 102, a key operation state recognizer 103, a response control determiner 104, a generator for execution preparatory control signal 105, and a generator for process execution control signal 106. Furthermore, both a generator for process-explanation display signal 108 and an on-screen display (OSD) display controller 109 are also provided as device for executing functions as software processing.

A controlled unit 107 includes a hardware module 1071 having a radio receiver unit 12, a CD player unit 13, a recording/reproducing unit 14, and so on in the electronic apparatus body 1 and the control unit 10 includes a software module 1072 to be executed as software processing.

When the remote-control signal receiver 101 receives a remote-control signal from the remote-control transmitter 2, the received remote-control signal is supplied to the operation key recognizer 102 and the key operation state recognizer 103. Here, as described above, there are two types of remote-control signals received by the remote-control signal receiver 101, a preparatory remote-control signal and an active remote-control signal.

With reference to the information for identifying an operation key, which is included in a preparatory remote-control signal and an active remote-control signal, tithe operation key recognizer 102 determines and recognizes which is an operation key currently touched or which is a depressed operation key. The operation key recognizer 102 supplies the results of the determination and recognition to the response control determiner 104.

When the received remote-control signal includes information that indicates the user's touch on the operation key, the key operation state recognizer 103 recognizes that the received remote control signal is a preparatory remote-control signal. When the received remote-control signal includes information that indicates the operation key is being depressed, the key operation state recognizer 103 recognizes that the received remote control signal is an active remote-control signal. The key operation state recognizer 103 supplies the results of recognition whether the received remote-control signal is a preparatory remote-control signal or an active remote-control signal to the response control determiner 104.

When the response control determiner 104 determines that the received remote-control signal is a preparatory remote-control signal in response to the results of recognition of the key operation state recognizer 103, the response control determiner 104 directs the generator for execution preparatory control signal to generate a control signal corresponding to the touched operation key. The instruction includes the information that represents the touched operation key.

The generator for execution preparatory control signal 105 generates an execution preparatory control signal corresponding to the operation key currently touched according to the instruction from the response control determiner 104. Subsequently, the generator for execution preparatory control signal 105 supplies the generated execution preparatory control signal to the controlled unit 107, and then adjusts the hardware module 108 and/or the software module participating in processing corresponding to the operation key currently touched to an execution preparatory state.

Here, the term "execution preparatory control" means the process of control where the processing operation to be executed by depression of an operation key being touched is immediately performed without delay when the operation key is actually depressed. The details of the execution preparatory control will be described later.

If the response control determiner 104 discriminates that a received remote-control signal is a preparatory remote-control signal, it directs the generator for process-explanation display signal 108 to generate a display signal that explains a processing operation to be executed upon depression of the touched operation key. The instruction includes the information that represents the touched operation key.

The generator for process-explanation display signal 108 includes a storage unit (not shown) where information about explanation display for process processing is stored. Here, the processing operation is executed when the touched operation key is depressed in responses to the information that indicates each of the operation keys. In this example, the information about explanation display includes an explanation message. In this embodiment, this explanation-displaying information includes an explanation message that explains a processing operation performed when the touched operation key in text. Furthermore, a display that explains a processing operation to be executed when any of operation keys is depressed is referred to as a process explanation display.

The generator for process-explanation display signal 108 reads out the explanation-displaying information from the above storage unit. This explanation-displaying information corresponds to information that indicates the touched operation key contained in the instruction from the response control determiner 104. Subsequently, the generator for process-explanation display signal 108 supplies the read explanation-displaying information to the OSD display controller 109. The OSD display controller 109 controls a process explanation display sentence containing a character string for process explanation display based on the explanation-displaying information to display on the screen of the display 100.

Therefore, the user can recognize a processing operation (processing function), which is performed when the touched operation key is depressed, from the process explanation display sentence by touching the surface of the operation key. That is, before actually depressing an operation key, a processing operation performed by depression of the operation key can be checked before the actual depression of the operation key.

Therefore, an operation mistake of an operation key can be prevented by reading a process explanation display sentence. The process explanation display sentence allows the user to recognize the kind of a processing operation performed when the operation key is depressed.

In general, a printed message, such as a name of the operation or processing function to be executed, is displayed near the operation key. However, the space of the display is too narrow. Thus, operation keys for the respective processing operations are hardly distinguished from one another. On the other hand, a process explanation display sentence is displayed on a display screen and is capable of displaying a comparatively long explanation sentence. The user can recognize what kind of processing operation is carried out when depressing the operation key.

When the response control determiner 104 determines that the received remote-control signal is an active remote-control signal on the basis of the recognition result of key operation state recognizer 103, the response control determiner 104 directs the generator for process execution control signal 106 to generate a control signal corresponding to the depressed operation key.

The generator for process execution control signal 106 generates a process execution control signal corresponding to the depressed operation key according to the instruction from the response control determiner 104. Subsequently, the generator for process execution control signal 105 supplies a generated process execution control signal to the controlled unit 107. In response to the process execution control signal, the controlled unit 107 starts the hardware module 1071 and/or software module 1072. Here, the hardware module 1071 and/or software module 1072 participate(s) in processing corresponding to the depressed operation key, thereby executing a corresponding process.

In this embodiment, the controlled unit 107 has completed the preparation for performing the processing corresponding to the depressed operation key before receiving the process execution control signal, the processing corresponding to the depressed operation key can be performed quickly.

<Description of Execution Preparatory Control>

(1) Execution Preparatory Control for Hardware Module

In this embodiment, as described above, the hardware module includes the radio receiver unit 12, the CD player unit 13, and the recording/reproducing unit 14. The control unit 10 supplies control signals to the radio receiver unit 12, the CD player unit 13, and the recording/reproducing unit 14 through the system bus 11. Thus, under the control of the control unit 10, each of the units is allowed to receive supply voltage and to be switched between the standby state and the start-up state (execution state).

On the other hand, in each of the operation keys 221, 222, . . . , and 22*n* of the key operation unit 22 of the remote-control transmitter 2, the depression of such a key may be related to the control of any of the hardware modules or may be related to the control of all the hardware modules.

Key depression may be related to the control of a plurality of hardware modules at the time of recording radio broadcasting on a recording medium, dubbing from a CD to a recording medium, or the like.

Here, as described above, the execution preparatory control for the hardware modules is control processing where the processing operation to be executed by depression of an operation key being touched is immediately performed without delay when the operation key is actually depressed. In this embodiment, an example of such control processing will be described. In this example, a hardware module controlled in the case of processing performed by depression of the operation key is previously changed from a standby state to an executable state by power activation.

For example, when the user touches a CD playback key on the remote-control transmitter 2 in radio-broadcasting receiving mode, the remote-control transmitter 2 transmits a preparatory remote-control signal thereof to the electronic apparatus body 1. The electronic apparatus body 1 receiving this preparatory remote-control signal controls the CD player unit 13 from a standby state to a start-up state after checking charge of CD.

In addition, when the user touches an instruction key for dubbing CD on the remote-control transmitter 2 in radio-broadcasting receiving mode, the remote-control transmitter 2 transmits a preparatory remote-control signal thereof to the electronic apparatus body 1. The electronic apparatus body 1 receiving this preparatory remote-control signal controls the CD player unit 13 and the recording/reproducing unit 14 from a standby state to a start-up state after checking charge of CD.

Furthermore, if the electronic apparatus body 1 is already set to a control state instructed by the preparatory remote-control signal, there is no problem even if preparatory remote-control signals are output in piles. The control unit 10 of the electronic apparatus body 1, which is already in control state, may perform processing while ignoring a remote-control signal that instructs the electronic apparatus body 1 to be such a control state. The same will be also applied to an active remote-control signal.

(2) Execution Preparatory Control for Software Module

The execution preparatory control for software module will be described herein with the following two examples. One of the exemplified execution preparatory controls is to read a program application, which will be executed when a touching operation key is depressed, in a cash memory.

The other of the exemplified execution preparatory controls is to raise the priority level of an application program which will be executed when a touching operation key is depressed among program applications for the respective processes.

Hereafter, the above two exemplified execution preparatory controls will be more described in detail.

(2-1) Pre-Read Processing

In general, a software process is designed that a system control program runs on the operating system (OS) 300 while an execution application program APL runs. The system control program is written in a predetermined memory area 301.

In addition, an execution application program (in the figure, an application program is referred to as APL) is written in a memory area 302 for execution application program of the cache memory. The execution application program is stored in a main memory 303 or a hard disk 304. In advance of execution of the program, it will be written in the memory area 302 of the cash memory from the main memory 303 or the hard disk 304.

Therefore, if an application program which is going to be executed is not present in the memory area 302 of the cash memory, it is necessary to read the program from the main memory 303 or the hard disk 304 into the memory area 302 of the cash memory. As a result, delay of start-up occurs. In particular, in the case of transmission from the hard disk 304 to the memory area 302 of the cash memory, the delay becomes large in many cases.

In the present invention, therefore, an additional memory area 305 is formed in the cash memory to previously write an application program to be executed when a touching operation key (hereinafter, such a program will be referred to as a preparatory application program).

In addition, when any of the operation keys is touched by the user, an application program which will be executed when such an operation key is depressed is written as a preparatory application program into the memory area 305. When the touched operation key is pressed by the user, the preparatory application program is moved to the memory area 302 and provided as an execution application program to initiate the processing. Alternatively, the application program in the memory area 305 may be used as an executive program application and the memory area 302 may be used as an area where the preparatory application program is written.

It constitutes as mentioned above, an application program stored in the memory area 305 of the preparatory application program can be immediately shifted to an execution mode, when the touched operation key is depressed.

Figures 7A, 7B, 7C:
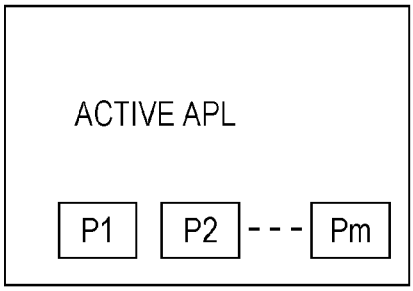
FIG. 7 is a block diagram illustrating an example of execution preparatory control in the electronic apparatus in accordance with the first embodiment of the present invention.

(2-2) As shown in FIG. 7A, which is a diagram illustrating the priority level of a process program, the execution application program generally includes two or more processing processes P1, P2, . . . , Pm (m is an integer of 2 or more). Furthermore, fixed priority levels are assigned to two or more processing processes P1, P2, . . . , and Pm in advance, respectively. For this reason, when performing a low-priority processing process next, delay may arise in the starting thereof.

Then, in this embodiment, in first stage, as shown, for example in FIG. 7B, a priority level is given about two or more processing processes P1, P2, . . . , Pm, but their priority levels may be changed. Furthermore, when the user touches any of the operation keys, the priority level of the processing process to be executed upon the depression of such an operation key is raised as shown in FIG. 7C.

Each of examples shown in FIG. 7B and FIG. 7C represents that a processing process for a repeat playback is low-priority at first but changed to a higher level because the user has touched on an operation key that instructs to perform the repeat playback.

Furthermore, the execution preparatory control for hardware modules and the execution preparatory control for software modules have been described for illustrative purposes. Any kind of processing may be employed as long as it is designed to perform the execution preparatory control.

<Example of Process Explanation Display when Operation Key is Touched>

A process explanation display when those operation keys are touched with a specific example of a plurality of operation keys of the remote-control transmitter 2 in the first embodiment will be described. The process explanation display displayed on the display when an operation key is touched describes the contents of the processing operation (or processing function) performed when the operation key is depressed.

The operation keys of the remote-control transmitter 2 shown in FIG. 2 is equivalent to the corresponding operation keys 221 to 22*n* shown in FIG. 1 as described above, respectively.

For convenience of explanation, however, combinations of numeral 22 and alphabetic characters are allocated to the respective operation keys in FIG. 2.

An operation key 22RD is responsible for switching the mode of the electronic apparatus body 1 to a radio-broadcasting receiving mode when it is depressed and is referred to as a "radio key" in this example. The memory 303 or the hard disk 304 stores a message for process explanation display, "Enter the mode of receiving radio broadcast", which will be displayed when the radio key 22RD is touched.

An operation key 22RD is responsible for switching the mode of the electronic apparatus body 1 to a CD-playing mode when it is depressed and is referred to as a "CD key" in this example. The memory 303 or the hard disk 304 stores a message for process explanation display, "Enter the mode of playing CD", which will be displayed when the radio key 22RD is touched.

An operation key 22HD is responsible for switching the mode of the electronic apparatus body 1 to a play mode of the recording/reproducing unit 14 when it is depressed and is referred to as a "HD key" in this example. The memory 303 or the hard disk 304 stores a message for process explanation display, "Enter the mode of playing from HD", which will be displayed when the HD key 22HD is touched.

In addition, an operation key 22MN is a menu key and allows the electronic apparatus body 1 to display a menu list of items of entry settings on the screen of the display 100 when the operation key 22MD is depressed. Thus, the user may select a desired setting item from the menu list and enters the selected setting item.

The memory 303 or the hard disk 304 stores a message for process explanation display, "Display a menu list of setting items", which will be displayed when the menu key 22MN is touched.

An operation key 22VR is a seesaw type operation key (operation rocker key) for turning up or down volume. In this example, it is referred to as a "volume key". If the volume-up side (+) of the operation rocker key 22VR is depressed, then the volume of sound from the loudspeaker 19 is increased. If the volume-down side (−) of the operation key 22VR is depressed, then the volume of sound from the loudspeaker 19 is decreased.

The memory 303 or the hard disk 304 stores a message for process explanation display, "Turn up volume", which will be displayed when the volume-up side (+) of the operation rocker key is touched. The memory 303 or the hard disk 304 stores a message for process explanation display, "Turn down volume", which will be displayed when the volume-up side (−) of the operation rocker key is touched.

When any of the above operation keys is depressed, the depression of the key corresponds to only one processing process to be executed by depression of the key even if the electronic apparatus body is set to any of the aforementioned modes.

In the case of such an operation key, since only one processing operation is performed when the operation key is depressed, only one kind of the process explanation display information may be used. In other words, only one kind of the process explanation display information, which corresponds to one operation key, may be stored in the storage unit of the generator for process-explanation display signal 108.

However, there is also an operation key to which processing operations are assigned so that the processing operation to be executed by depression of the operation key may be changed depending on the operating state (mode) of the electronic apparatus at the time of the key depression. Such a configuration of the operation key is provided for avoiding a difficulty in operation. That is, if the operation key corresponds to only one of processing operations for the respective modes, a large number of operation keys will be provided and each of the keys will be designed to be very small while the space for these operation keys is limited.

In particular, the electronic apparatus of the first embodiment is designed as a complex electronic apparatus that includes a plurality of electronic devices. In the remote-control transmitter of this kind of the complex electronic apparatus, if the operation key corresponds to only one of functions of the respective electronic devices, each of the keys will be designed to be very small while the space for these operation keys is limited.

Then, he is trying to make what can be made to serve a double purpose serve a double purpose in this first embodiment in a plurality of modes which an operation key mentioned above.

For example, the operation key 22UD is a rocker key that instructs upward/downward and is referred to as an "up-and-down key" in this example. In radio-broadcasting receiving mode, when the upward side (UP) of the up-and-down key 22UD is depressed, among preset broadcasting stations, a broadcasting station to be received is changed to another broadcasting station having a frequency higher than that of a broadcasting station currently received. In addition, if the downward side (DW) of the up-and-down key 22UD is depressed, a broadcasting station to be received is changed to another broadcasting station having a frequency lower than that of a broadcasting station currently received.

Furthermore, if the upward side (UP) of the up-and-down key 22UD is depressed in CD playing mode, a music track to be played is changed to a next one. If the downward side (DW) of the up-and-down key 22UD is depressed in CD playing mode, a music track to be played is changed to the previous one. The same is also applied to the reproducing mode of the recording/reproducing unit 14.

Therefore, when the mode of electronic apparatus body concerned when being touched is a radio-broadcasting receiving mode, different messages of process explanation display to be displayed when the user touches the up-and-down key 22D is stored are provided for the radio-broadcasting receiving mode of the electronic apparatus body 1 and the reproducing mode of the recording/reproducing unit 14, respectively.

That is, a message of process explanation display, "Broadcasting station to be received is changed to one having a higher frequency", is stored for the electronic apparatus body 1 in radio-broadcasting receiving mode when the user touches the upward side (UP) of the up-and-down key 22UD. In addition, a message of process explanation display, "Music track is changed to the next one", is stored for the reproducing mode of the recording/reproducing unit 14 when the user touches the upward side (UP) of the up-and-down key 22UD.

Furthermore, a message of process explanation display, "Broadcasting station to be received is changed to one having a lower frequency", is stored for the electronic apparatus body 1 in radio-broadcasting receiving mode when the user touches the downward side (DW) of the up-and-down key 22UD. In addition, a message of process explanation display, "Music track is changed to the previous one", is stored for the reproducing mode of the recording/reproducing unit 14 when the user touches the downward side (DW) of the up-and-down key 22UD.

Among the operation keys, some may be effective in certain mode but not in other modes.

For example, an operation key REC instructs the recording/reproducing unit 14 to record information into a recording medium and is referred to as a "recording key". In this embodiment, in a radio-broadcasting receiving mode, this record key REC becomes effective, only when recording a broadcasting signal under reception on a hard disk. When the recording key REC is depressed, the broadcasting signal currently received is recorded in the hard disk from the time of the depletion.

Furthermore, the recording apparatus body 1 of the present embodiment is designed to use a dubbing key 22DB when music contents recorded in CD are dubbed to the hard disk. In other words, when the dubbing key 22DB is depressed, the recording apparatus body 1 in CD playing mode performs dubbing of all the music contents in CD to the hard disk from the beginning.

Figure 8A:
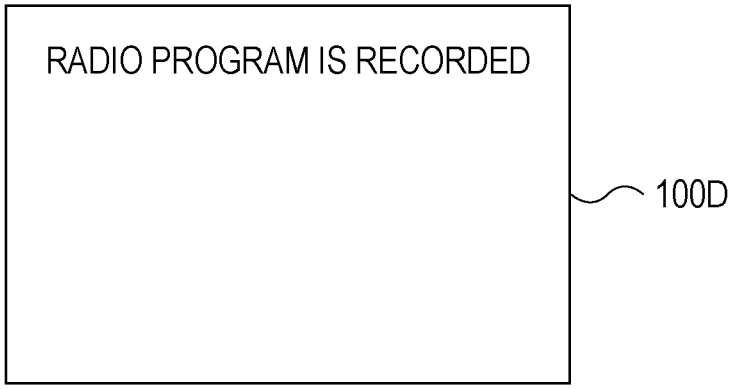
FIG. 8A illustrates an example in which a user touches a recording key in radio reception mode and FIG. 8B illustrates an example in which a user touches a recording key in CD replay mode.
Figure 8B:
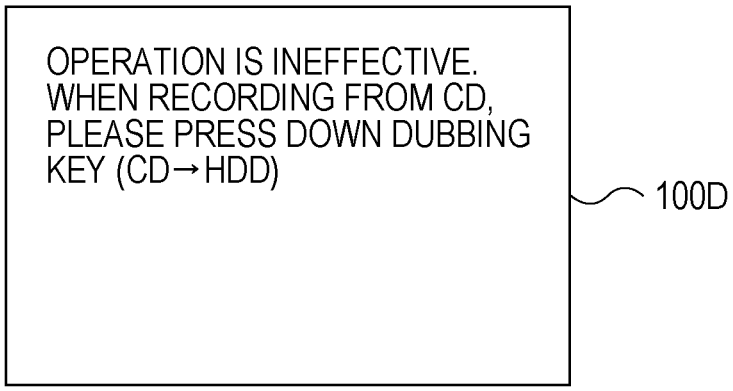

In the present embodiment, therefore, a message of process explanation display, "Start radio-broadcast recording", as shown in FIG. 8A when the user touches the recording key REC and the recording apparatus body 1 is in radio-broadcasting receiving mode. In addition, a message of process explanation display, "It is ineffective. Press dubbing key (CD→HDD) when start dubbing of CD", as sown in FIG. 8B when the user touches the recording key REC and the recording apparatus body 1 is in radio-broadcasting receiving mode.

An operation key 22PB is designed to start playing music contents from CD or the hard disk when the recording apparatus body 1 is in CD playing mode or in mode of reproducing from the hard disk and is referred to as a playback key. The mode of reproducing from the hard disk is hereafter referred to as a HDD reproducing mode.

The playback key 22PB is designed to be responsible for both the CD playing mode and the HDD reproducing mode. In this embodiment, furthermore, the playback key 22PB is an invalid operation key in radio-broadcasting receiving mode.

In the present embodiment, therefore, a message of process explanation display, "Start playback of CD", when the user touches the playback key 22PB and the recording apparatus body 1 is in CD playing mode. In the present embodiment, therefore, a message of process explanation display, "Start reproduction from hard disk", when the user touches the playback key 22PB and the recording apparatus body 1 is in HDD reproducing mode. Furthermore, a message of process explanation display, "It is ineffective", when the user touches the playback key 22PB and the recording apparatus body 1 is in radio-broadcasting receiving mode.

As described above, the storage unit in the control unit 10 of the electronic apparatus body 1 stores information about messages of process explanation display which will be represented when the user touches the respective operation keys depending on the processing functions assigned to the respective operation keys.

The operation key 22CS is a composite cross key including four direction keys and a decision key. Such a key may be used for selecting a setting item from a menu list of setting items.

<Display Setup of Process Explanation Display>

In this embodiment, a user sets up whether a process explanation display is performed when the user touches the operation key.

In addition, user setting items include an item of determining whether the process explanation display is performed with a large font to facilitate visualization or with a small font, or whether the process explanation display is moderately performed.

In other words, as described above, if the user depresses the menu key 22M, then the control unit 10 of the electronic apparatus body 1 of the embodiment displays the display screen 100D of the display 100. If an item of allowing the user to set up a process explanation display is selected from the items of the set-up item menu, then the user setting of the process explanation is executed.

Figure 9:
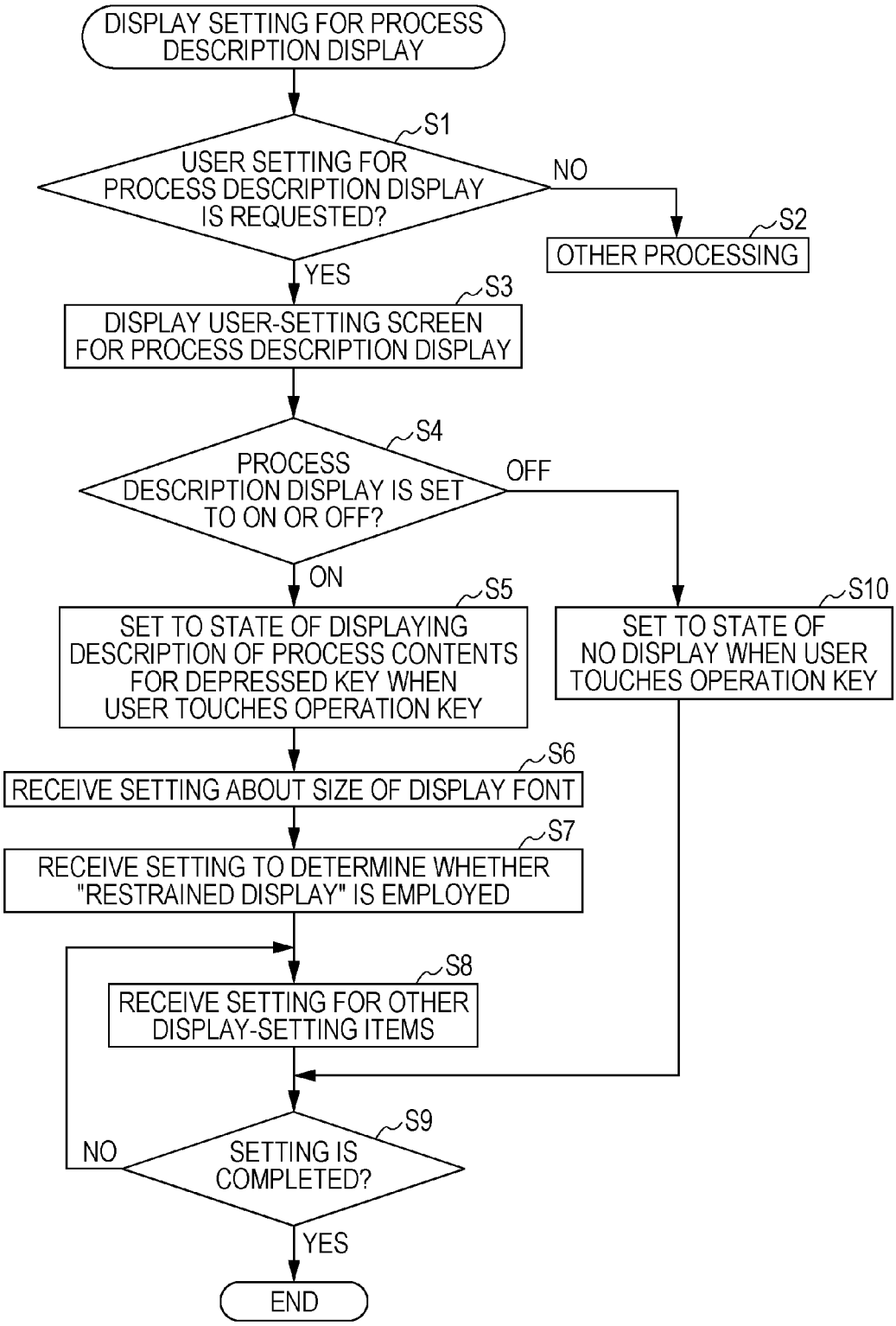
FIG. 9 is a diagram illustrating a flow chart of an exemplary process routine of setting a process explanation display in the electronic apparatus in accordance with the first embodiment of the present invention.

FIG. 9 is a flow chart illustrating that the user sets a processing operation of setting a process explanation display. The steps of the process represented by the flowchart describe that the control unit 10 of the electronic apparatus body 1 receives a remote-control signal from a remote-control transmitter 2 through a remote-control signal receiving unit 15 and then analyzes the remote-control signal to execute the contents thereof.

First, the control unit 10 determines whether an item of allowing the user to setup the process explanation display is selected while the list of the set-up item menu is displayed on the display screen 100D of the display 100 (Step S1). In this step S1, if it is determined that the item of allowing the user to setup the process explanation display is not selected, then the control unit 10 executes processing of another set-up item selected by the user (Step S2).

In this step S1, if it is determined that the item of allowing the user to setup the process explanation display is selected, then the control unit 10 displays a user-setting screen of process explanation display. It is displayed on the display screen 100D of the display 100 (Step S3).

Subsequently, the user's setting input is determined whether a process explanation display, which is the first set-up item, is displayed when the user touches any of the operation keys (display ON) or not displayed (display OFF) (Step S4).

In step S4, if it is determined that the user's setting input is display ON, then the control unit 10 sets a state of displaying a process explanation display as a configuration of the electronic apparatus body 1 for the process explanation display when the user touches the operation key (Step S5).

Next, the control unit 10 displays a user-setting screen for allowing the user to determine the size of a display font for process explanation display on the display screen 100D of the display 100, followed by receiving and registering a setting input about the size of the display font (Step S6).

Next, the control unit 10 displays a user setting screen for allowing the user to determine whether the process explanation display is moderately displayed or highlighted on the display screen 100D of the display 100, followed by receiving and receiving the setting input (Step S7).

Next, the control unit 10 displays a screen that urges the user to set another set-up item of the process explanation display, followed by receiving the setting input (Step S8).

Subsequently, the control unit 10 discriminates whether the control unit 10 receives from the user an input indicating that all the setting inputs are completed (Step S9). If it is discriminated that the control unit 10 does not receive from the user an input indicating that all the setting inputs are completed, then the process returns to step S8 and sets an undefined item.

Furthermore, in step S9, the control unit 10 completes the process routine of FIG. 9 when the control unit 10 receives from the user an input indicating that all the setting inputs are completed.

In step S4, if it is determined that the user's setting input is display OFF, then the control unit 10 sets a state that the process explanation display is not displayed even if the user touches the operation key as a configuration of the electronic apparatus body 1 for the process explanation display (Step S10). Subsequently, the process proceeds from step S10 to step 9, performing the aforementioned process in step S9.

<Processing Operation of Remote-Control Transmitter 2>

Figure 10:
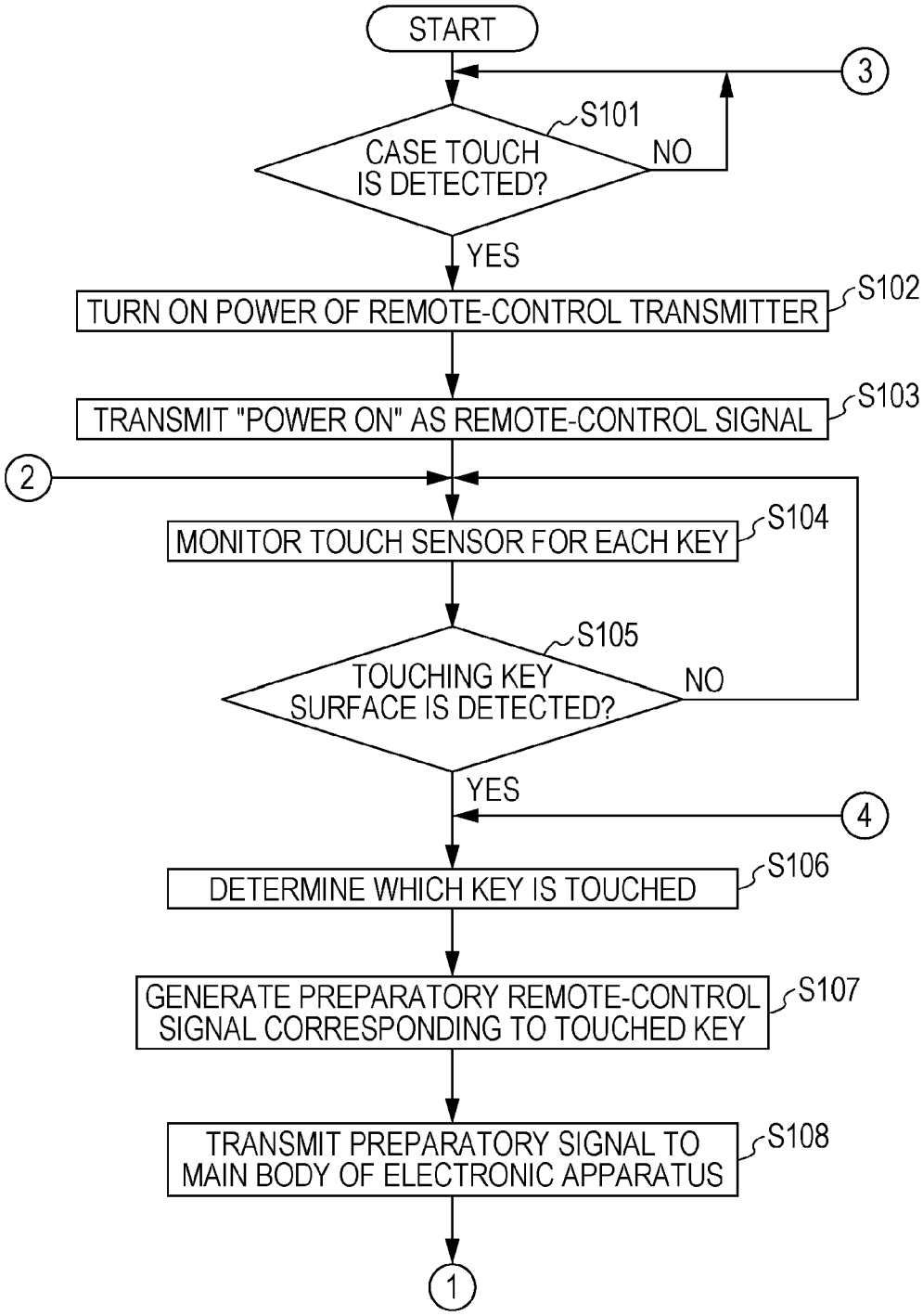
FIG. 10 is a diagram illustrating part of a flow chart of an exemplary processing operation of the remote-control transmitter provided for the electronic apparatus according to the first embodiment of the present invention.
Figure 11:
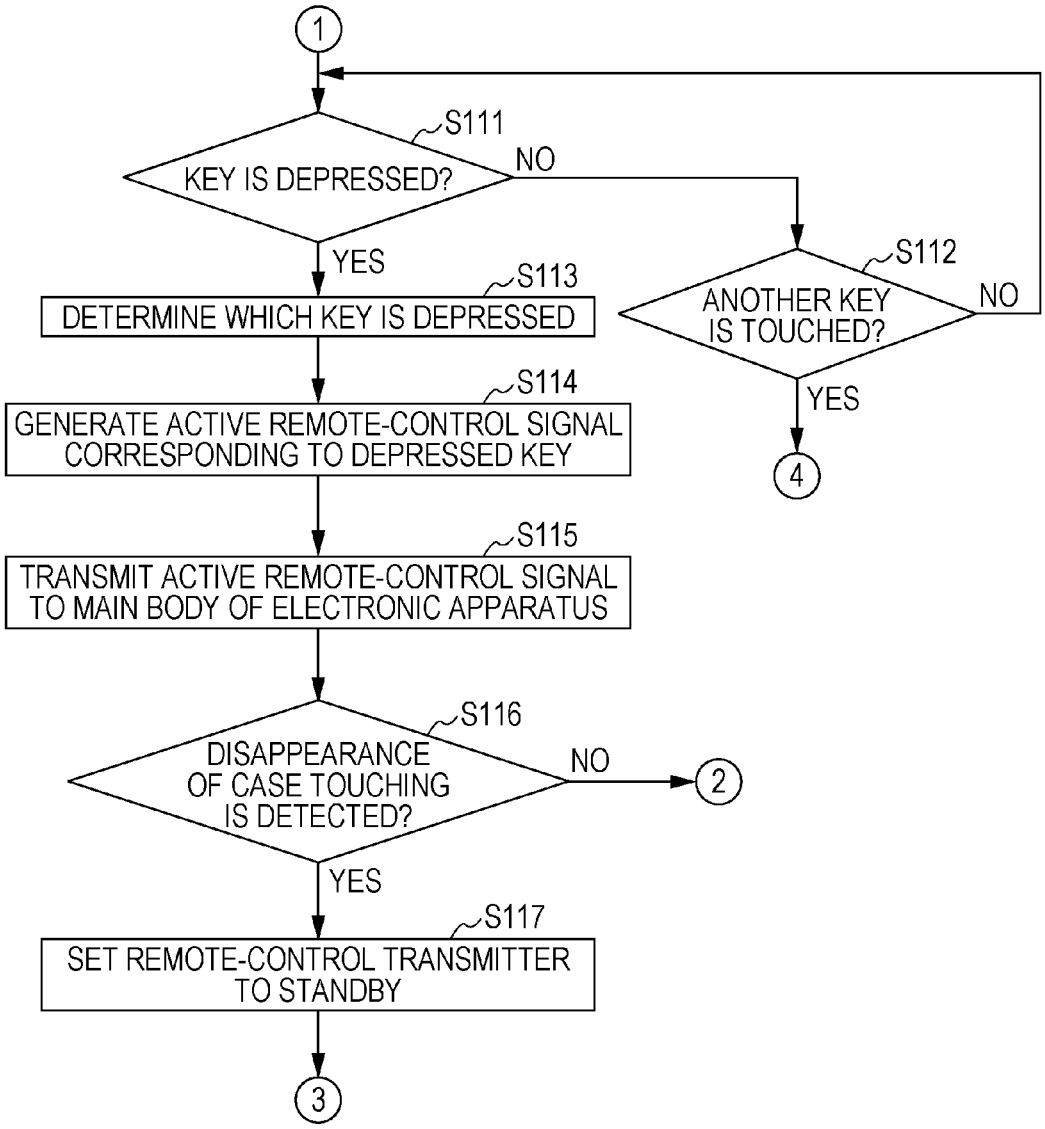
FIG. 11 is a diagram illustrating part of the flow chart of the exemplary processing operation of the remote-control transmitter provided for the electronic apparatus according to the first embodiment of the present invention.

Referring now to a flow chart illustrated in FIG. 10 and FIG. 11, the flow of a process mainly performed by the control unit 20 in the aforementioned remote-control transmitter 2 will be described. The control unit 20 is designed to perform each step of the process shown in FIG. 10 and FIG. 11 according to an application program dedicated thereto.

First, the control unit 20 monitors a detection output to determine whether the user touches the case of the remote-control transmitter 2 (Step S101). If it is determined that the case is touched, then the process proceeds to step S101.

In step S101, if it is determined that the user touches the case of the remote-control transmitter 2, then the control unit 20 powers on all the unit of the remote-control transmitter 2 and then starts the remote-control transmitter 2 (Step S102). Next, the control unit 20 transmits an active remote-control signal to the electronic apparatus body 1. The active remote-control signal is responsible for instructing the electronic apparatus body 1 to be powered on (Step S103).

Next, the control unit 20 monitors a detection output from the touch sensor part 22B of each operation key on the remote-control transmitter 2 (Step S104). Then, the control unit 20 determines whether the user touches the operation key (Step S105). In this step S105, if the control unit 20 determines that the user does not touch the operation key, then the process goes back to step S104, followed by continuously monitoring the detection output of the touch sensor 22B of each operation key.

Furthermore, in step S105, if it is determined that the user touches the operation key, then the control unit 20 determines which operation key is touched (Step S106) and generates a preparatory remote-control signal corresponding to a touched operation key (Step S107). Next, the control unit 20 transmits the generated preparatory remote-control signal to the electronic apparatus body 1 (Step S108).

Subsequently, the control unit 20 determines whether the operation key is depressed (Step S111 in FIG. 9). If it is determined that the operation key is not depressed, then it is determined whether any of other operation keys is touched (Step S112). In this step S112, if the control unit 20 determines whether the user does not touch any of other operation keys, then the process returns to step S111. Furthermore, if the control unit 20 determines that the user touches another operation key, then the process returns to step S106 and a process of transmitting a preparatory remote-control signal is then performed on the basis of touching another operation key.

In step S111, if the control unit 20 determines that the operation key is depressed, then the control unit 20 determines what kind of the operation key is depressed (Step S113) and generates an active remote-control signal corresponding to the depressed operation key (Step S114). Furthermore, the control unit 20 transmits the generated active remote-control signal to the electronic apparatus body 1 (Step S115). Next, the control unit 20 monitors detection output from the case of the touch sensor unit 23 and determines whether the case of the remote-control transmitter 2 is no longer touched (Step S116). If it is determined that the case of the remote-control transmitter 2 is still being touched, then the process returns to step S104. Furthermore, if the control unit 20 determines that the case of the remote-control transmitter 2 is no longer touched, then the control unit 20 sets only a necessary part of the remote-control transmitter 2 to a standby state where supply voltage is supplied to the necessary part (Step S117). Subsequently, the process returns to step S101 and then the subsequent steps are repeated.

<Control Operation for Remote-Control Signal Reception in Electronic Apparatus Body 1>

Figure 12:
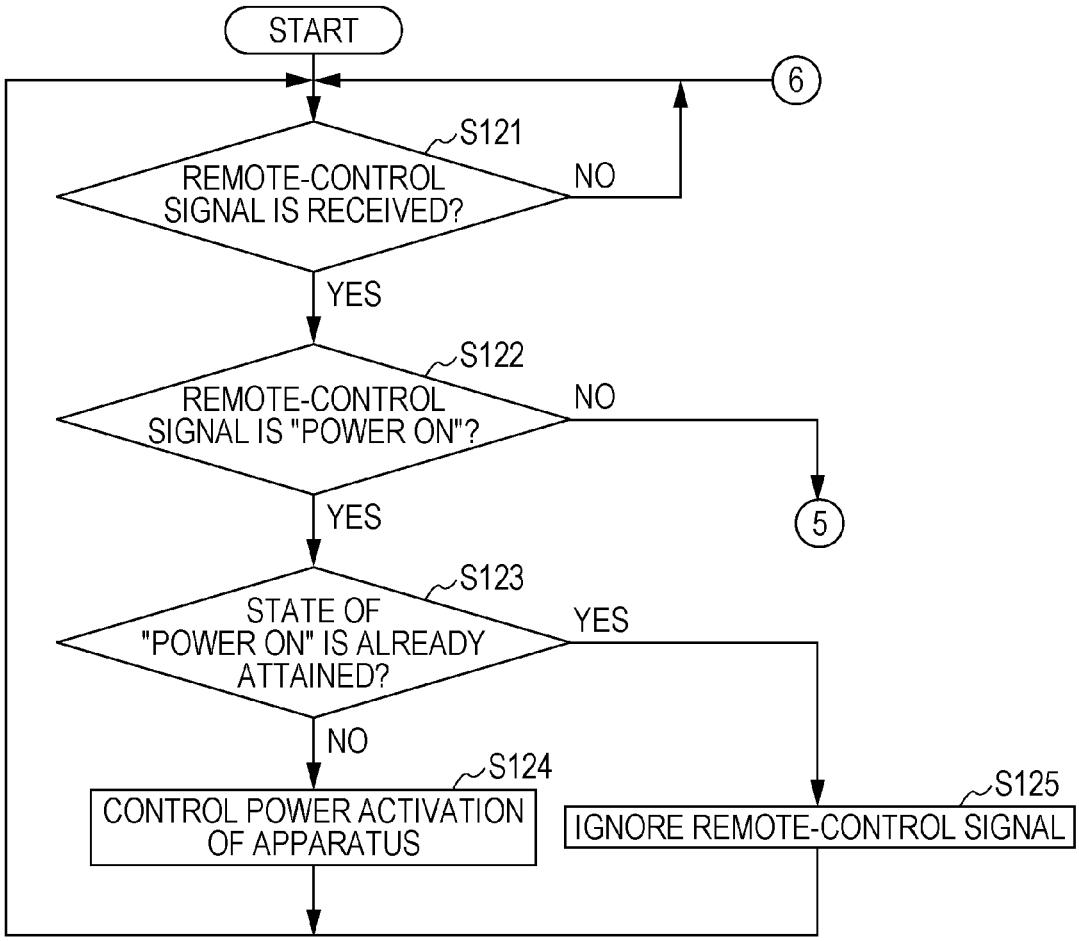
FIG. 12 is a diagram illustrating part of the flow chart of the exemplary processing operation of the electronic apparatus body according to the first embodiment of the present invention.
Figure 13:
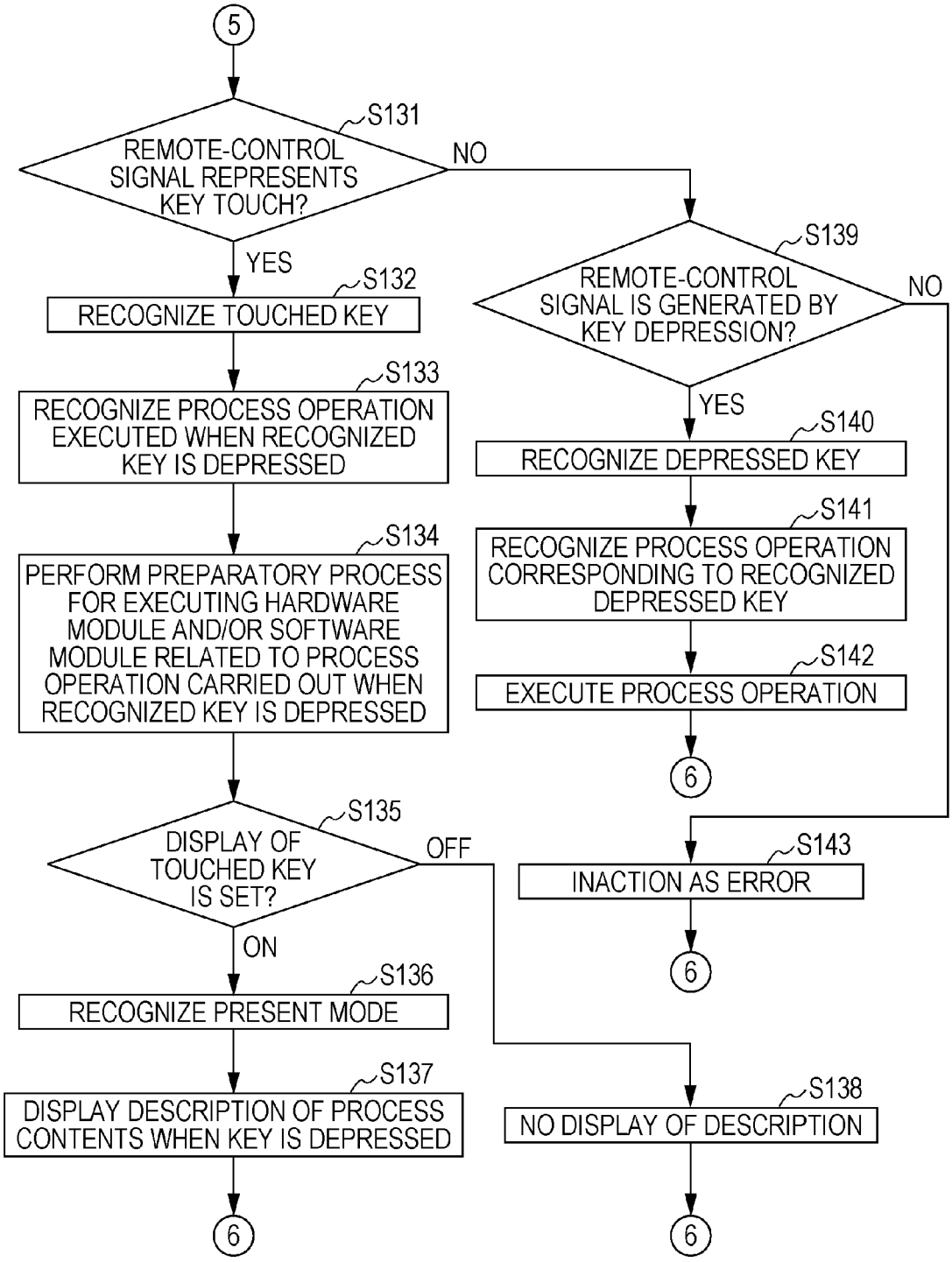
FIG. 13 is a diagram illustrating part of the flow chart of the exemplary processing operation of the electronic apparatus body according to the first embodiment of the present invention.

Next, a flow chart illustrated in FIG. 12 and FIG. 13 represents the flow of a process mainly performed by the control unit 10 when remote-control signals (preparatory remote-control signal and an active remote-control signal) transmitted from the remote-control transmitter are received as described above. The control unit 10 is designed to perform each step of the process shown in FIG. 12 and FIG. 13 according to an application program dedicated thereto.

First, the control unit 10 monitors an output from the remote-control signal receiving unit 15 and waits for arrival of a remote-control signal (Step S121). In step S121, if the control unit 10 determines whether a remote-control signal is received, then the control unit 10 determines whether the remote-control signal is an active remote-control signal that instructs to power on (Step S122).

In step S122, if the control unit 10 determines that the remote-control signal is the active remote-control signal that instructs to power on, then the control unit 10 determines, in this example, whether the electronic apparatus body 1 is already powered on (Step S123). Subsequently, in step S123, it is determined that the electronic apparatus body 1 is already powered on, then the control unit 10 ignores and cancels the active remote-control signal that instructs to power on (Step S125). Thus, the process returns to step S121.

Furthermore, in step S123, if it is determined that the power source of the electronic apparatus body 1 is not yet turned on, then the control unit 10 controls the power unit 17 of the electronic apparatus body 1 to turn on the electronic apparatus body 1 (Step S124). At this time, the control unit 10 of the electronic apparatus body 1 memorizes a mode at the time of previous power off, so that the electronic apparatus body 1 will be brought into a mode at the time of previous power off. In other words, in mode at the time of previous power off, power supply voltage is supplied to a desired hardware module, and an unnecessary hardware module is controlled in standby state in the mode.

The process performed by the control unit 10 returns to step S121 after completing step S124.

In step S122, if the received remote-control signal is not an active remote-control signal that instructs to power on, then the control part 10 discriminates whether the received remote-control signal is a preparatory remote-control signal caused by touching the operation key (Step S131).

In step S131, if the control unit 10 discriminates that the received remote-control signal is the preparatory remote-control signal, then the control unit 10 uses information for identifying an operation key contained in the preparatory remote-control signal to recognize which key the user has touched (Step S132).

Next, the control unit 10 recognizes a processing operation (or a processing function, hereinafter the same will apply) to be executed upon depression of the recognized touched operation key (Step S133). After that, a process of execution preparatory control for a hardware module and/or software related to the recognized processing operation is performed (Step S134).

Next, the control unit 10 determines whether the display setting about the touched operation key is display ON or display OFF (Step S135). In this step S185, it the control unit 10 determines that the display setting about the touched operation key is display ON, then the control unit 10 recognizes the operation mode of the electronic apparatus body 1 at this time (Step S136).

Subsequently, on the basis of the operation key and the operation mode, the control unit 10 reads out from the storage unit the information of process explanation display about the contents of the processing operation when the touched operation key is depressed. Then, the control unit 10 displays the information on the display screen 100D of the display 100 (Step S137).

In this embodiment, as described above, the operation mode of electronic apparatus body 1 at that time is recognized in step S136. When reading the information of process explanation display from the storage unit, the operation mode at that time is referred. This mentioned above, even if different kinds of control processing are assigned on one operation key depending on different operation modes, the explanation display for the processing operation executed by depression of this operation key is correctly performed.

Furthermore, the processing operation when the touched operation key is pressed is already in that state, for example, a processing explanation display, such as "Repeated; already playback now", may be performed when the playback key 22PB is touched while a CD is playing.

Following step S137, the process returns to step S121 and the control unit 10 waits arrival of the next remote-control signal.

Furthermore, in step S135, if the control unit 10 determines that the display setting of the touched operation key is display OFF, then the control unit 10 finds no process explanation display and performs nothing (Step S138).
Furthermore, the process returns to step S121 and waits for arrival of the next remote-control signal.

If the control unit 10 determines that the received remote-control signal is not a preparatory remote-control signal in step S131, then the control unit 10 determines whether the received remote-control signal is an active remote-control signal generated by depression of the operation key (Step S139).

If it is determined that the received remote-control signal is the active remote-control signal in step S139, then the control unit 10 uses information for identifying an operation key contained in the active remote-control signal to recognize which key the user has depressed (Step S40).

Next, the control unit 10 recognizes a processing operation to be executed corresponding to the recognized depressed operation key (Step S141). After that, the control unit 10 performs the instructed control processing using a hardware module and/or a software module related to the recognized control operation (Step S142). Furthermore, the process returns to step S121 and the control unit 10 waits for arrival of the next remote-control signal.

Moreover, in Step S139, if the control unit 10 determines that the received remote-control signal is not the active remote-control signal, then the control unit 10 defines that the received signal is not a remote-control signal but an error and performs nothing (Step S143). In the control unit 10, furthermore, the process returns to step S121 and the control unit 10 waits for arrival of the next remote-control signal.

Second Embodiment

In the above description about the first embodiment, the electronic apparatus body 1 has been described such that the number of operation keys to be touched by the user is one. However, if many operation keys are formed on the remote-control transmitter 2, the distance between the operation keys adjacent to each other is insufficient. Even though the user can depress a desired operation key, therefore, the user may accidentally depress one or more other operation keys around the desired one.

In the case of the aforementioned first embodiment, if two or more operation keys are simultaneously touched by the user, their respective preparatory remote-control signals are generated and transmitted to the electronic apparatus body 1. In addition, the process explanation display about each of all the touched operation keys is displayed on the display 100. Even if it is of no matter, it may be inefficient because of additional execution preparatory control on the undesired operation key depressed by the user. In addition, the appearance of an unexpected process explanation display may obscure the explanation display about the processing operation or processing function demanded by the user.

In the second embodiment, therefore, the remote control transmitter 2 is designed to determine (estimate) one operation key which the user intends to depress when the user simultaneously touches two or more operation keys. Then, the remote-control transmitter 2 generates only a preparatory remote-control signal corresponding to one operation key determined or estimated by the user.

Figure 14:
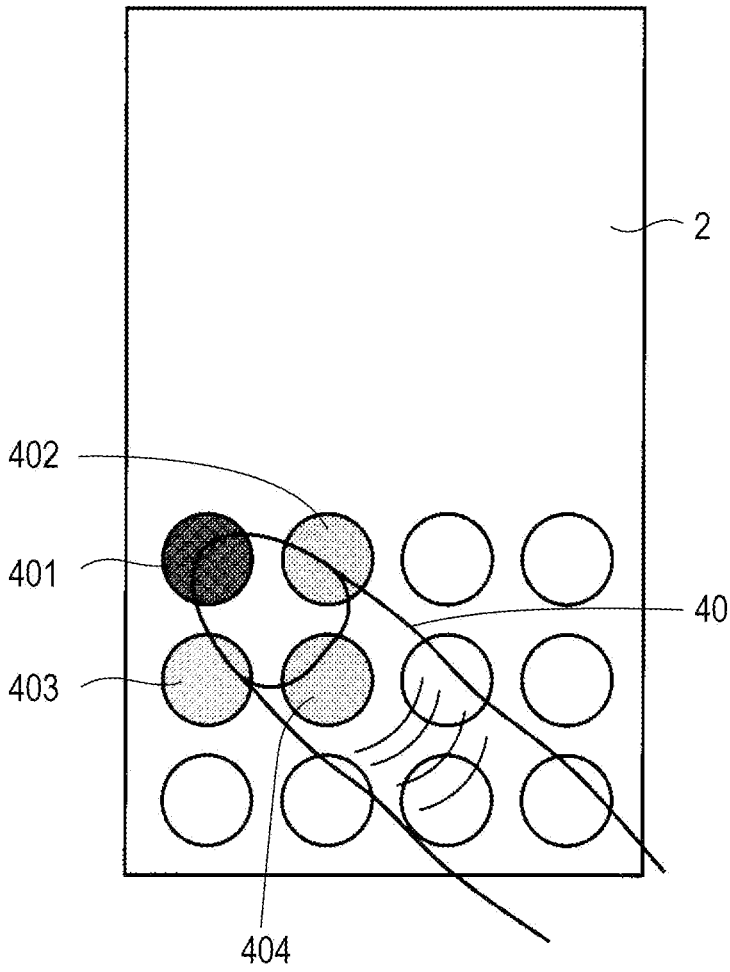
FIG. 14 is a diagram illustrating an electronic apparatus according to a second embodiment of the present invention.

In the case of an example shown in FIG. 14, the user holds the case of the remote-control transmitter 2 in his or her right hand and intends to operate an operation key by his or her thumb 40. In the example shown in FIG. 14, when a desired operation key 401 is touched before depression, four operation keys 401, 402, 403, and 404 (shaded circles in the figure) may be touched because of being close to one another.

Usually, the user may depress the operation key by the tip of his or her thumb 40. Therefore, in the example shown in FIG. 14, it is possible to define the operation key 401 (strongly shaded circle) located on the upper left side of four shaded operation keys 401 to 404 as an operation key which the user intends to subsequently depress.

Figure 15:
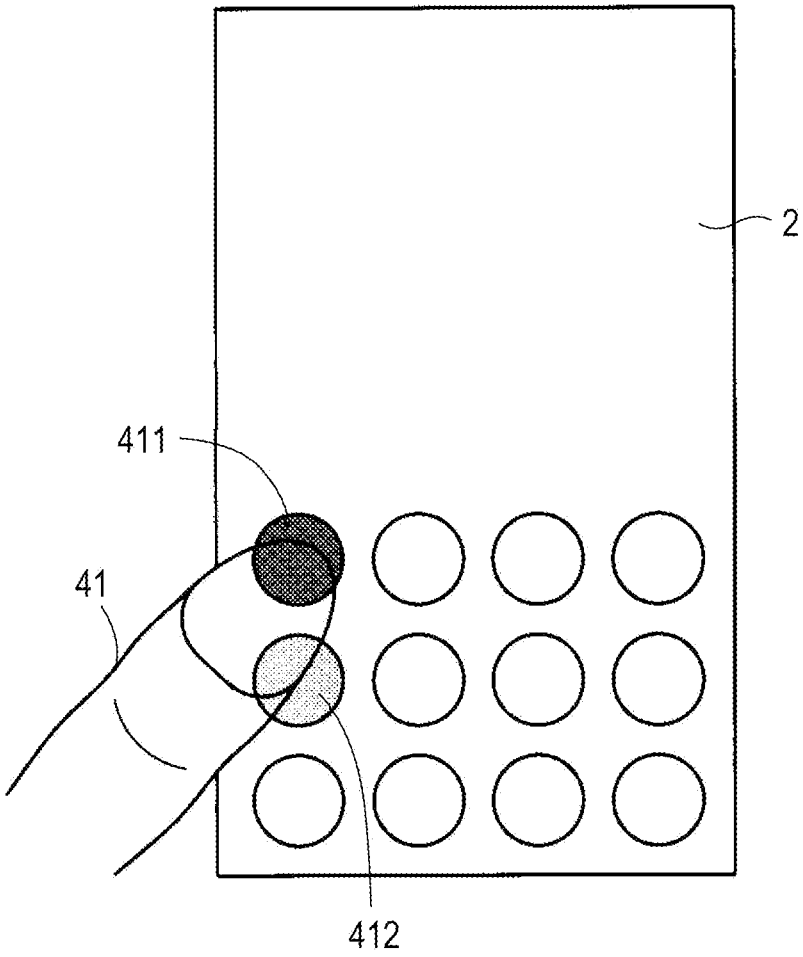
FIG. 15 is a diagram illustrating an electronic apparatus according to a second embodiment of the present invention.

Furthermore, in the case of an example shown in FIG. 15, the user holds the case of the remote-control transmitter 2 in his or her left hand and operates an operation key by his or her thumb 41. In the example shown in FIG. 15, when a desired operation key 411 is touched before depression, two operation keys 411 and 412 (shaded circles in the figure) may be touched because of being close to one another.

Therefore, in consideration of depressing one operation key by the tip of the thumb, it is possible to define the upper operation key 411 (strongly shaded circle) of two shaded operation keys 411 and 412 as an operation key which the user intends to subsequently depress.

Furthermore, the case touch sensor unit 23 for detecting whether the user touches the case of the remote controller 2 is designed to further detect a touching position. Thus, the operation key on the tip side of the thumb can be detected on the basis of the relationship between the position of the user's palm and the position of the user's thumb. Alternatively, the operation key may be determined similarly, except for the operation with any of fingers other than the thumb.

The hardware configuration of the electronic apparatus according to the second embodiment is completely the same as that of the first embodiment shown in FIG. 1. However, the configuration of software executed in a remote-control transmitter 2 is different from that of the first embodiment. Hereinafter, the software configuration of the remote-control transmitter 2 of the second embodiment will be described. In this embodiment, the software configuration of the electronic apparatus body 1 is not different from that of the first embodiment.

<Functional Block Diagram of Remote-Control Transmitter 2 according to Second Embodiment>

Figure 16:
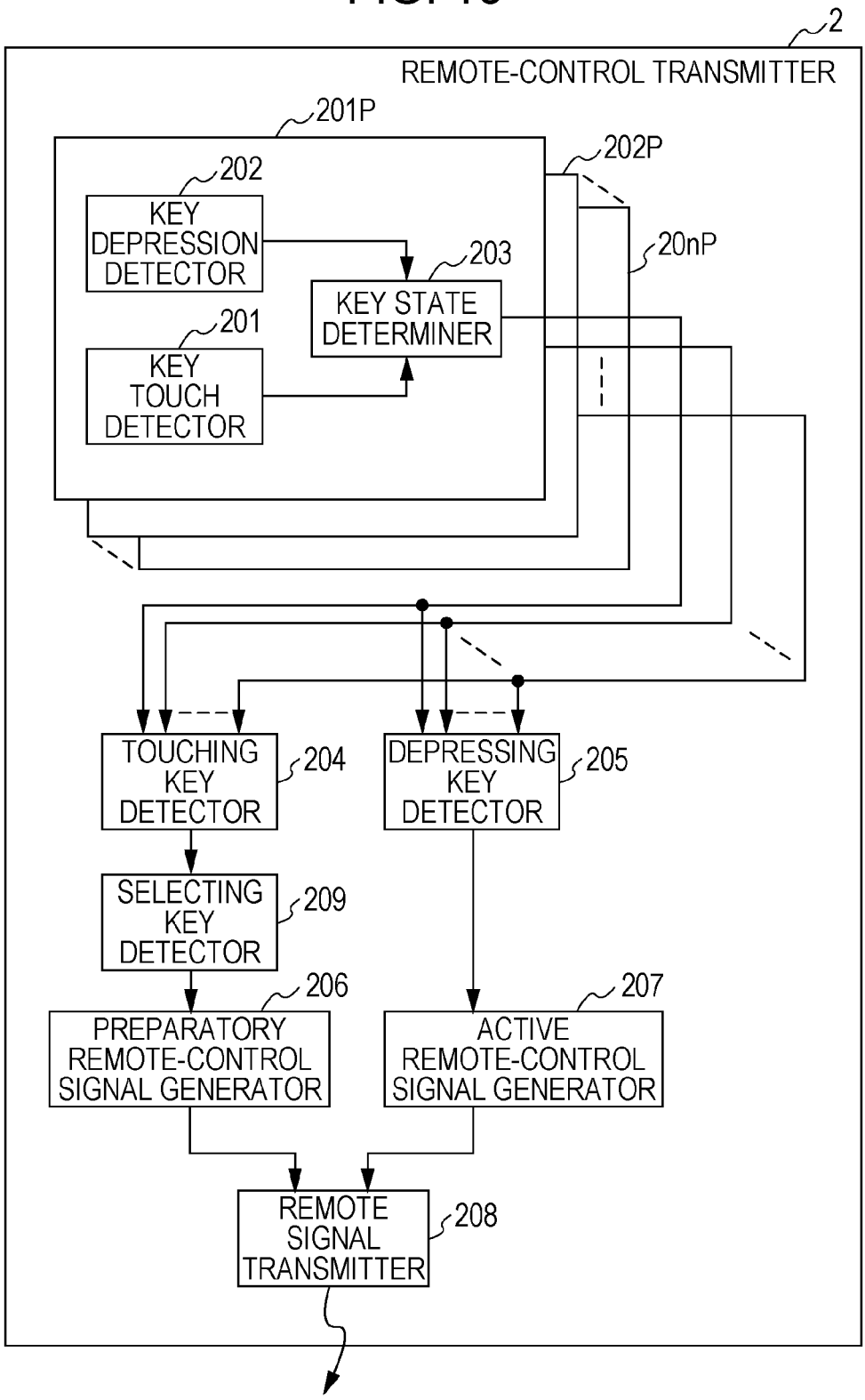
FIG. 16 is a functional block diagram of the remote-control transmitter provided for the electronic apparatus in accordance with the second embodiment of the present invention.

FIG. 16 is a functional block diagram illustrating a remote-control transmitter 2 in mainly consideration of the processing carried out by the control unit 20 of the above remote-control transmitter 2 in accordance with a second embodiment of the present invention. In FIG. 16, the same structural components as those of the remote-control transmitter 2 of the first embodiment shown in FIG. 4 are provided with the same reference numerals as those of FIG. 4.

In the second embodiment, a selecting key detector 209 is formed between a touching key detector 204 and a preparatory remote-control signal generator 206. Subsequently, when detecting the operation key currently touched, the touching key detector 204 supplies a key detection output signal, which contains both information that identifies the operation key currently touched and information that the operation key is being touched, to the selecting key detector 209.

Among two or more operation keys which the user touches, the selecting key detector 209 determines an operation key which the user intends to depress in a manner similar to one described with reference to FIG. 14 and FIG. 15. In addition, if there is one operation key currently touched, then the selecting key detector 209 determines such an operation key as one which the user touches while intending to depress.

Furthermore, in the second embodiment, the output of selecting key determination is supplied to the preparatory remote-control signal generator 206. Here, such an output includes information for identifying one operation key being determined and information for indicating that the operation key is being touched.

The preparatory remote-control signal generator 206 generates a preparatory remote-control signal when a touching key detection output signal is output from the touching key detector 204. This preparatory remote-control signal includes both information that identifies an operation key currently touched and information that the operation key is being touched by the user in the touching key detection output signal.

When the preparatory remote-control signal generator 206 generates this preparatory remote-control signal, the preparatory remote-control signal is transmitted to the electronic apparatus body 1 through the remote-control transmitter 208.

Other structural components and processing operation are the same as those of remote-control transmitter 2 of the first embodiment as described above with reference to FIG. 4.

<Processing Operation of Remote-Control Transmitter 2 According to Second Embodiment>

Next, the flow of a process mainly performed by the control unit 20 of the remote-control transmitter 2 of the second embodiment will be described.

In comparison with the processing operation of the remote-control transmitter 2 of the first embodiment as described with reference to FIG. 10 and FIG. 11, the processing operation of the remote-control transmitter 2 of the second embodiment is only different from the first embodiment in steps shown in FIG. 8. Thus, the processing operation of the remote-control transmitter 2 of the second embodiment will be described with reference to FIG. 17 in replacement of FIG. 10. The steps shown in FIG. 11 are subsequent steps of the process shown in FIG. 17.

Figure 17:
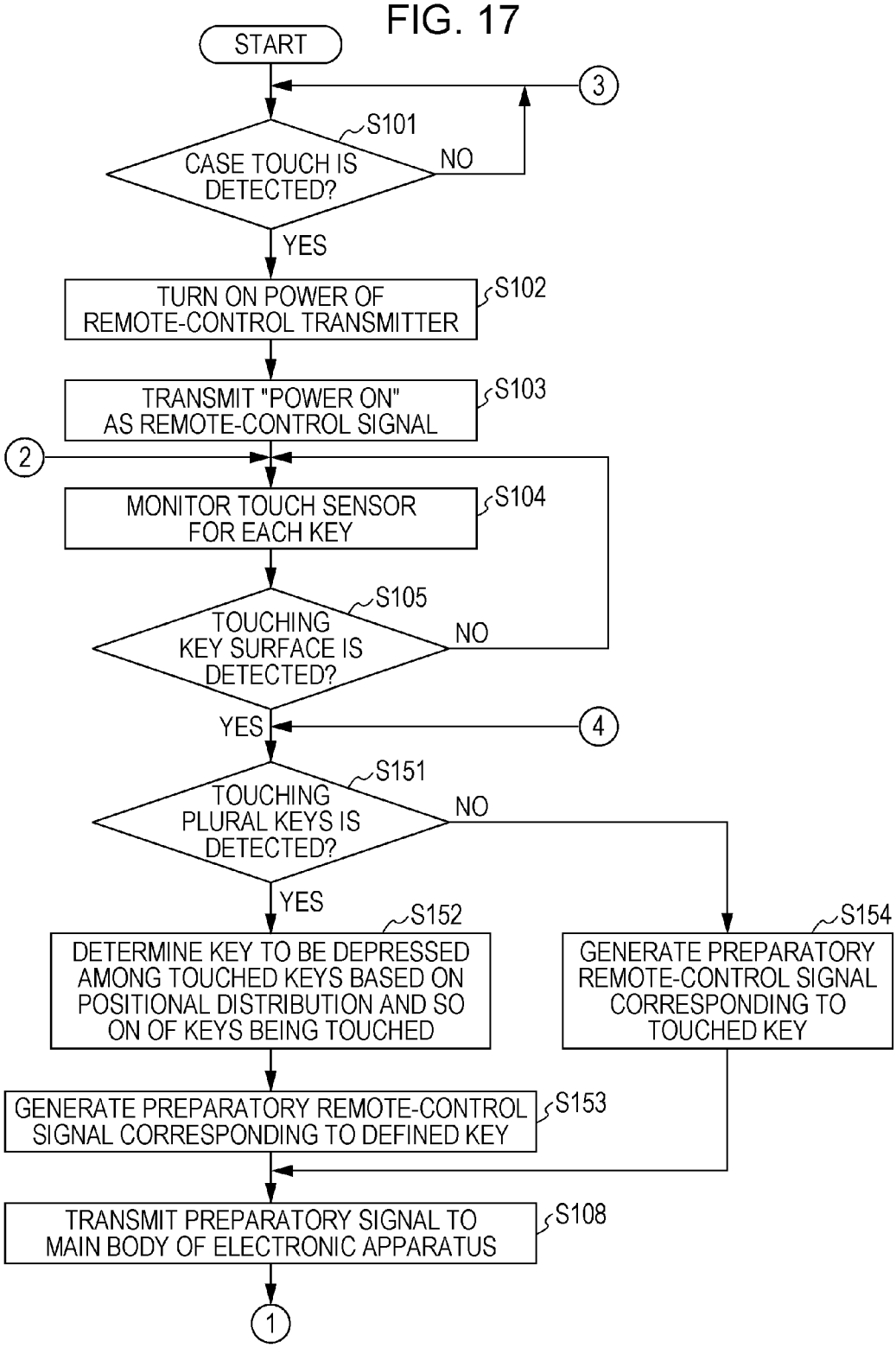
FIG. 17 is a diagram illustrating part of a flow chart of an exemplary processing operation of the remote-control transmitter provided for the electronic apparatus according to the second embodiment of the present invention.

In each of the steps shown in FIG. 17, processing is performed using an application program.

In FIG. 17, steps from S101 to S105 correspond to those of the first embodiment. According to this 2nd embodiment, when it determines that an operation key was touched at Step S105, control unit 20 judges whether a touched operation key is plurality (Step S151).

If the control unit 20 determines that the user touches two or more operation keys in step S141, then the control unit 20 determines one operation key which the user intends to depress from the positional distribution of these operation keys being touched (Step S152).

Next, the control unit 20 generates a preparatory remote-control signal corresponding to the determined operation key (Step S153).

If the control unit determines that only one operation key is touched by the user in step S151, then the control unit 20 generates a preparatory remote-control signal corresponding to the determined operation key (Step S154).

Subsequent to step S153 or S154, the control unit 20 transmits the generated preparatory remote-control signal to the electronic apparatus body 1 (Step S108). Then the process proceeds from step S108 to step S111 in FIG. 11 and the same processing as that of the first embodiment is performed.

According to the second embodiment, therefore, even if there are two or more operation keys currently touched by the user, only a preparatory remote-control signal from the remote-control transmitter 2 corresponding to the operation key which may be operated by the user is presumed to be transmitted to the electronic apparatus body 1. Therefore, a process explanation display also serves as only one corresponding to such a presumed operation key concerned. Thus, the unexpected depression of operation keys mentioned at the beginning of the description of the second embodiment will not occur.

Third Embodiment

Any of the above embodiments has been described as the electronic apparatus where the main body thereof receives a remote-control signal from the remote-control transmitter having a key operation unit. Alternatively, it will be appreciated that any embodiment of the present invention may be applied to an electronic apparatus having a key operation unit.

Figure 18:
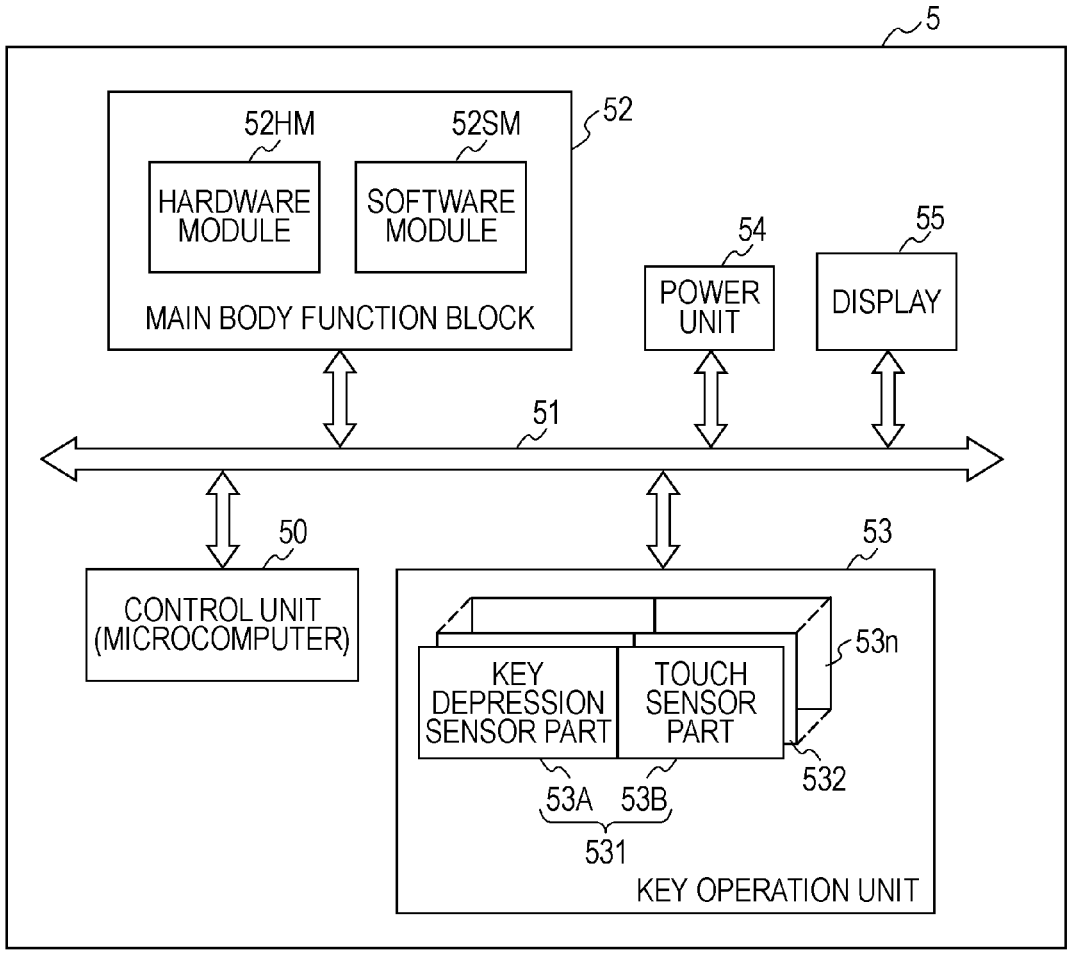
FIG. 18 is a block diagram illustrating an exemplary configuration of an electronic apparatus in accordance with a third embodiment of the present invention.

FIG. 18 illustrates an exemplary hardware configuration of an electric apparatus 5 according to a third embodiment of the present invention.

In the electronic apparatus 5 of the third embodiment, a system bus 51 is connected to a main body functional block 52, a key operation unit 53, a power unit 54, and a display 55. The display 55 may be constructed of a liquid crystal display (LCD) and associated parts thereof.

Furthermore, the system bus 51 is further connected to a control unit 50 that controls the whole of the electronic apparatus 5 while controlling each unit connected to the system bus 51. In this example, the control unit 50 includes a microcomputer. In this example, during that the electronic apparatus 5 is powered on, supply voltage is applied to the control unit 50.

The LCD of the display 55 is provided with a backlight part (not shown). Supply voltage may be also applied from the power unit 54 to the backlight part under control of the control unit 50. In other words, the control unit 50 may supply the voltage to the backlight part at a previously defined time of making a display brighter to emphasize on a new representation or the like on the display 55.

The main body functional block 52 is a block for executing functions of the electronic apparatus. The configuration of the main body functional block 52 is similar to that of the main body 1 of the electronic apparatus of the first embodiment. In the second embodiment, for simplifying the description, the main body of the electronic apparatus is illustrated as a block.

This main body functional block 52 includes a hardware module 52HM and a software module 52SM. The hardware module 52HM includes two or more hardware modules, such as a radio receiver unit 12, a CD player unit 13, and a recording/reproducing unit 14, which correspond to those of the main body 1 of the electronic apparatus of the first embodiment.

Obviously, the hardware module 52HM may include only one hardware module.

Each of hardware modules in the hardware module 52HM has a function of setting the hardware module in standby state just as in the case with any of the aforementioned embodiments. Thus, the hardware module can be switched between a start-up state and a standby state under control of the control unit 50.

In addition, the software module 52SM includes software programs for executing the respective functions together with the hardware modules of the hardware module 52HM.

In this third embodiment, in a manner similar to the above first embodiment, the control unit 50 is able to perform execution preparatory control on each of the hardware modules and software modules.

The key operation unit 53 includes a plurality of operation keys 531, 532, . . . , and 532*n* (n is an integer of 2 or more). In this embodiment, furthermore, each of the operation keys 531, 532, . . . , and 532*n* includes a key depression sensor part 53A and a touch sensor part 53B.

Since the configuration and action of the key operation unit 53 are the same as those of the key operation unit 22 of any of the aforementioned embodiments, the description thereof will be omitted herein.

<Functional Block Diagram of Electronic Apparatus 5>

Figure 19:
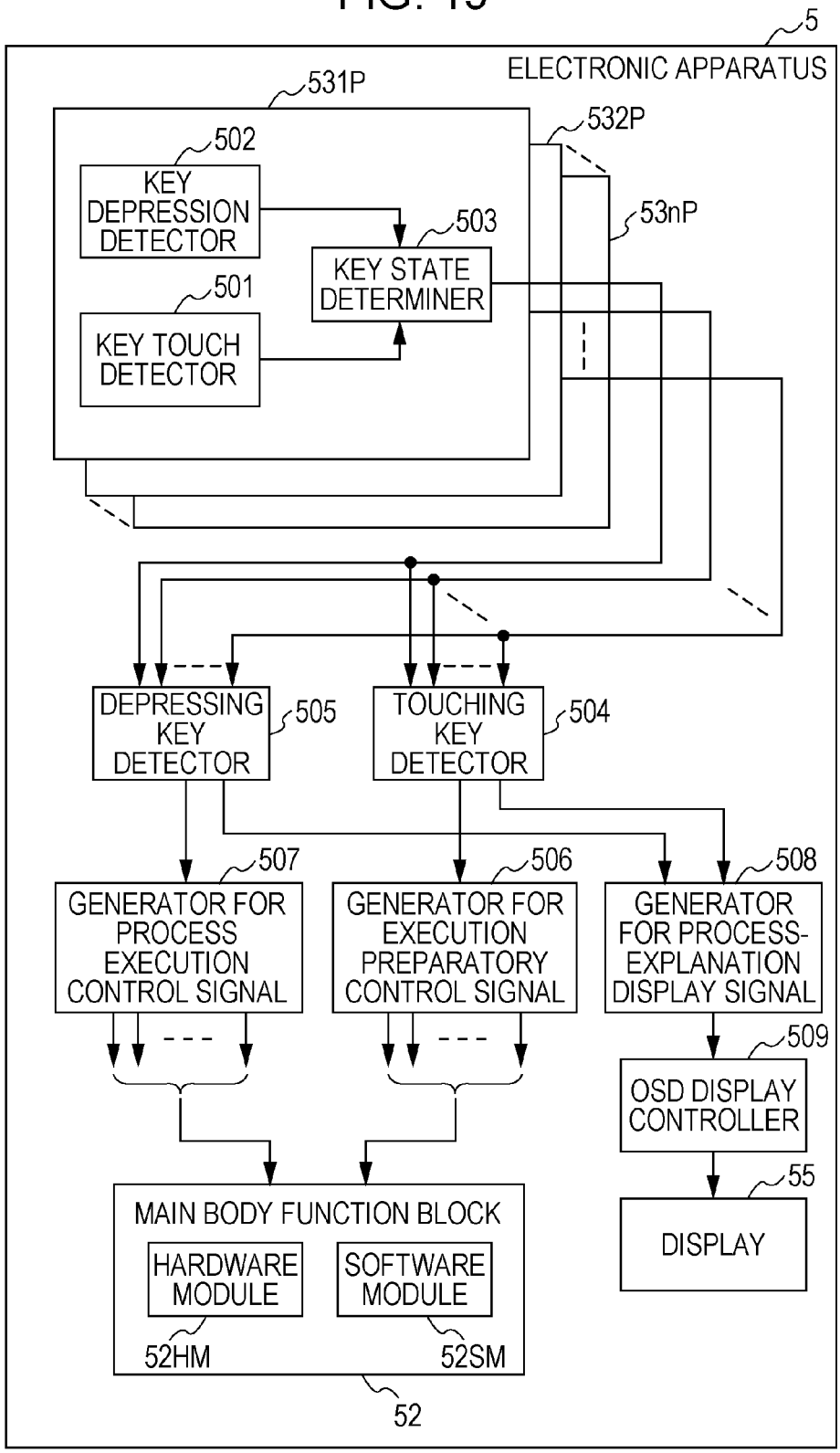
FIG. 19 is a functional block diagram illustrating an exemplary configuration of an electronic apparatus in accordance with the third embodiment of the present invention.

FIG. 19 is a functional block diagram illustrating a remote-control transmitter 2 in mainly consideration of the processing carried out by the control unit 50 of an electronic apparatus 5 of the third embodiment.

As shown in FIG. 19, the control unit 50 includes functional sections 531P, 532P, . . . , and 53*n*P that correspond to the respective operation keys 531, 532, . . . , and 53*n*, and detect the state of the operation key state among the three states shown in FIG. 3. In addition, the control unit 50 includes a touching key detector 504, a depressing key detector 505, a generator for execution preparatory control signal 506, a generator for process execution control signal 507, and the main body functional block 52. In addition, both a generator for process-explanation display signal 508 and an on-screen display (OSD) display controller 509 are also provided as device for executing functions as software processing.

Each of the functional sections 531P, 532P, . . . , and 53*n*P includes a key touch detector 501, a key depression detector 502, and a key state determiner 203.

The key touch detector 501 includes a touch sensor part 53B of each of the operation keys 531, 532, . . . , and 53*n* and a software process carried out in the control unit 20. The key touch detector 501 detects whether the user touches each of the operation keys. When detecting the user's touch on the target operation key, the key touch detector 501 generates a detection output showing such a fact to the key state determiner 503.

The key depression detector 502 includes a key depression sensor part 53A of each of the operation keys 531, 532, . . . , and 53*n* and a software process carried out in the control unit 50. The key depression detector 502 detects whether the user depresses each of the operation keys. When the key depression detector 502 that the target operation key is depressed is detected, it outputs a detection output showing such a fact to the key state determiner 503.

From a detection output from the key touch detector 501 and a detection output from the key depression detector, the key state determiner 503 determines whether the operation key is in any one of three states shown in FIG. 3. The result of the state determination is output. The result of the state determination from the key state determiner 503 is considered as an output of each of the functional sections 531P, 532P, . . . , and 53*n*P.

The outputs from the respective functional sections 531P, 532P, . . . , and 53*n*P, the results of the state determination for the respective operation keys, are supplied to the touching key detector 504 and the depressing key detector 505.

In this embodiment, the touching key detector 504 and the depressing key detector 505 are configured as software processing in the control unit 50, respectively.

The touching key detector 504 observes the results of the state determination of the operation keys from the respective functional sections 531P, 532P, . . . , and 53*n*P. If there is an operation key currently touched by user, the touching key detector 504 will detect such a fact.

Subsequently, when detecting the operation key currently touched, the touching key detector 504 supplies a key detection output signal, which contains both information that identifies the operation key currently touched and information that the operation key is being touched, to the generator for execution preparatory control signal 506. The touching key detector 504 also supplies a touching key detection output signal to the generator for process-explanation display signal 508.

From touching key detector 504, generator for execution preparatory control signal 506 generates an execution preparatory control signal corresponding to an operation key currently touched, when a touching key detection output signal is outputted.

Subsequently, the generator for execution preparatory control signal 506 supplies the generated execution preparatory control signal to the main body functional block 52, and then adjusts the hardware module and/or the software module participating in processing corresponding to the operation key currently touched to an execution preparatory state. The main body functional block 52 sets a hardware module and/or a software module, which are related to the depressed key among those in the hardware module 52HM and the software module SM, to an execution preparatory state.

Therefore, when the user touches any of operation keys 53*i* ("i" denotes a positive number not more than "n"), the key touch is detected by the key touch detector 501 of the functional section 531P of the touched operation key 53*i*. Subsequently, the key state determiner 503 of the functional section 531P outputs the result of the state determination that indicates the user's touch on the operation key 53*i*.

The touching key detector 504 detects the operation key currently touched and then transmits a touching key detection output signal to the generator for execution preparatory control signal 506 and also to the generator for process-explanation display signal 508.

The generator for execution preparatory control signal 506 generates an execution preparatory control signal and supplies the execution preparatory control signal to the main body functional block 52. In the main body functional block 52, the execution preparatory control signal is employed to set a hardware module and/or a software module, which are related to the depressed key among those in the hardware module 53HM and the software module SM, to an execution preparatory state.

The generator for process-explanation display signal 508 has the same configuration as that of the generator for process-explanation display signal 108 of the above first embodiment. In other words, the generator for process-explanation display signal 508 includes a storage unit (not shown) where information about explanation display for process processing is stored. Here, the processing operation is executed when the touched operation key is depressed in responses to the information that indicates each of the operation keys. In this embodiment, the explanation-displaying information is display information that explains in text characters a processing operation performed when the touched operation key is depressed.

The generator for process-explanation display signal 508 reads out the explanation-displaying information from the above storage unit. Here, the explanation-displaying information corresponds to information that indicates the touched operation key contained in a touching key detection output signal from the touching key detector 504. Subsequently, the generator for process-explanation display signal 508 supplies the read explanation-displaying information to the OSD display controller 509. The OSD display controller 509 controls a process explanation display sentence containing a character string for process explanation display based on the explanation-displaying information to display on the screen of the display 55.

Next, depressing key detector 505 observes the result of the state determination of each of operation keys of the respective functional sections 531P, 532P, . . . , and 53*n*P, if there is an operation key currently depressed by the user, the touching key detector 504 will detect such a fact.

Subsequently, when the depressing key detector 505 detects an operation key currently depressed, the depressing key detector 505 supplies an output signal of depressed key detection, which contains both information that identifies the operation key currently depressed and information that the operation key is being depressed, to the generator for process execution control signal 507. In this embodiment, the depressing key detector 505 also supplies an output signal of depressed key detection to the generator for process-explanation display signal 508.

The generator for process execution control signal 507 generates a process execution control signal, when an output signal of depressed key detection is output from the depressing key detector 505.

The generator for process execution control signal 507 generates a process execution control signal and supplies the process execution control signal to the main body functional block 52. In the main body functional block 52, the process execution control signal is employed to set a hardware module and/or a software module, which are related to the depressed key among those in the hardware module 52HM and the software module SM, to be initiated and executed. Therefore, processing corresponding to the depressed operation key is performed.

In this embodiment, if a processing operation corresponding to an depressed operation key is not performed by the electronic apparatus 5 in spite of depressing any of the operation keys, them the generator for process-explanation display signal 508 performs a process for displaying such a fact.

That is, if the generator for process-explanation display signal 508 receives the output signal of depressed-key detection, then it is determined whether a processing operation corresponding to the depressed operation key is not executable in the electronic apparatus 5. Subsequently, from the result of the determination, if the generator for process-explanation display signal 508 determines that the processing operation is not executable, then such a fact is displayed on the screen of the display 55 via the OSD display controller 509.

<Process Explanation Display in Third Embodiment>

(Another Example of Process Explanation Display)

In any of the aforementioned embodiments, the display contents of the process explanation display of the touched operation key are changed depending on the functions (modes) of the electronic apparatus and the respective states thereof. The third embodiment will be described in the light of a fact that a processing operation corresponding to an operation key in the electronic apparatus is not executable because of any of various factors.

In the electronic apparatus 5, an example of that a processing operation corresponding to a depressed operation key becomes not executable is as follows:

A first case is that, when the electronic apparatus is provided with a plurality of functions and modes (states), an operation key only effective to a particular faction or mode is touched or depressed at the time of another function or mode. In an example of this case, the details are the same as those of the first embodiment.

Another example of this case is that the electronic apparatus is a digital versatile disc (DVD) recorder and the management of a stop key is performed at the time of follow-up replay. In other wards, some of the DVD recorders are designed such that, when a so-called follow-up replay is performed while recording, recording is not stopped unless the replay of the recording is stopped.

In this case, during the follow-up replay, depressing the stop key stops the replay but not stops the recording. To stop the recording, the stop key is operated again after stopping the replay.

Therefore, when the stop key is touched during the follow-up replay, a process explanation display, "stop follow-up replay", is displayed on the screen of the display. Furthermore, if the stop key is touched again after stopping the replay, another process explanation display, "stop recording", is displayed on the screen of the display.

A second example of the case in which a processing operation corresponding to a depressed operation key is not executable in the electronic apparatus 5 is that a user operation is forbidden by the contents of a replay object. For example, in a case where the electronic apparatus is a DVD player, a user operation is forbidden because of the presence of movie contents recorded on DVD.

For example, when the movie contents are recorded on DVD, the user operation is forbidden at the beginning of the move contents or the ending thereof. In other words, the electronic apparatus is controlled on the basis of the attribute information about the movie contents recorded on the DVD where information about prohibition of user operation with respect to a specific replay section indicated by a replay time from the beginning of the movie contents is recorded.

When the user touches an operation key on the replay section of such prohibition of user operation, for example, a process explanation display, "the operation is forbidden", is displayed on the screen of the display. In this way, before the user depresses an operation key, the user receives an advice that the operation of the operation key is being forbidden. Therefore, the user will be prevented from being disappointed after depressing the operation key, compared with an announcement of "This operation is forbidden">

In this embodiment, even if an advice with a process explanation display when an operation key is touched is disregarded and an operation key is depressed, for example, a process explanation display, "This operation is forbidden", is displayed on the screen of the display.

Even if there is a function that exists as a media standard and the electronic apparatus or the remote-control transmitter also includes a corresponding operation key, the use of a recording medium which serves as a replay object but not support such a function leads to invalidation of any process corresponding to the operation key.

For example, in a case that a plurality of image contents taken from a plurality of angles may be recorded on DVD, a process explanation display may be changed depending on the replay of such contents and the replay of other contents. Even in the case of the contents of one movie, scenes taken from a plurality of angles and scenes taken from one angle are present.

Thus, an angle switching key may be formed on a key operation unit of the electronic apparatus or the remote-control transmitter thereof. In this case, when the user touches the angle key, the electronic apparatus determines whether the contents of a movie being replayed includes images taken from a plurality of angles as described above.

Subsequently, as a result of the determination, if images taken from a plurality of angles as described above are included in the contents or scene being replayed, the electronic apparatus displays a process explanation display, "Switch angle" on the screen of the display. Subsequently, as a result of the determination, if images taken from a plurality of angles as described above are not included in the contents or scene being replayed, the electronic apparatus displays a process explanation display, "Ineffective now" on the screen of the display.

<Flow Chart of Processing Operation for Process Explanation Display>

Figure 20:
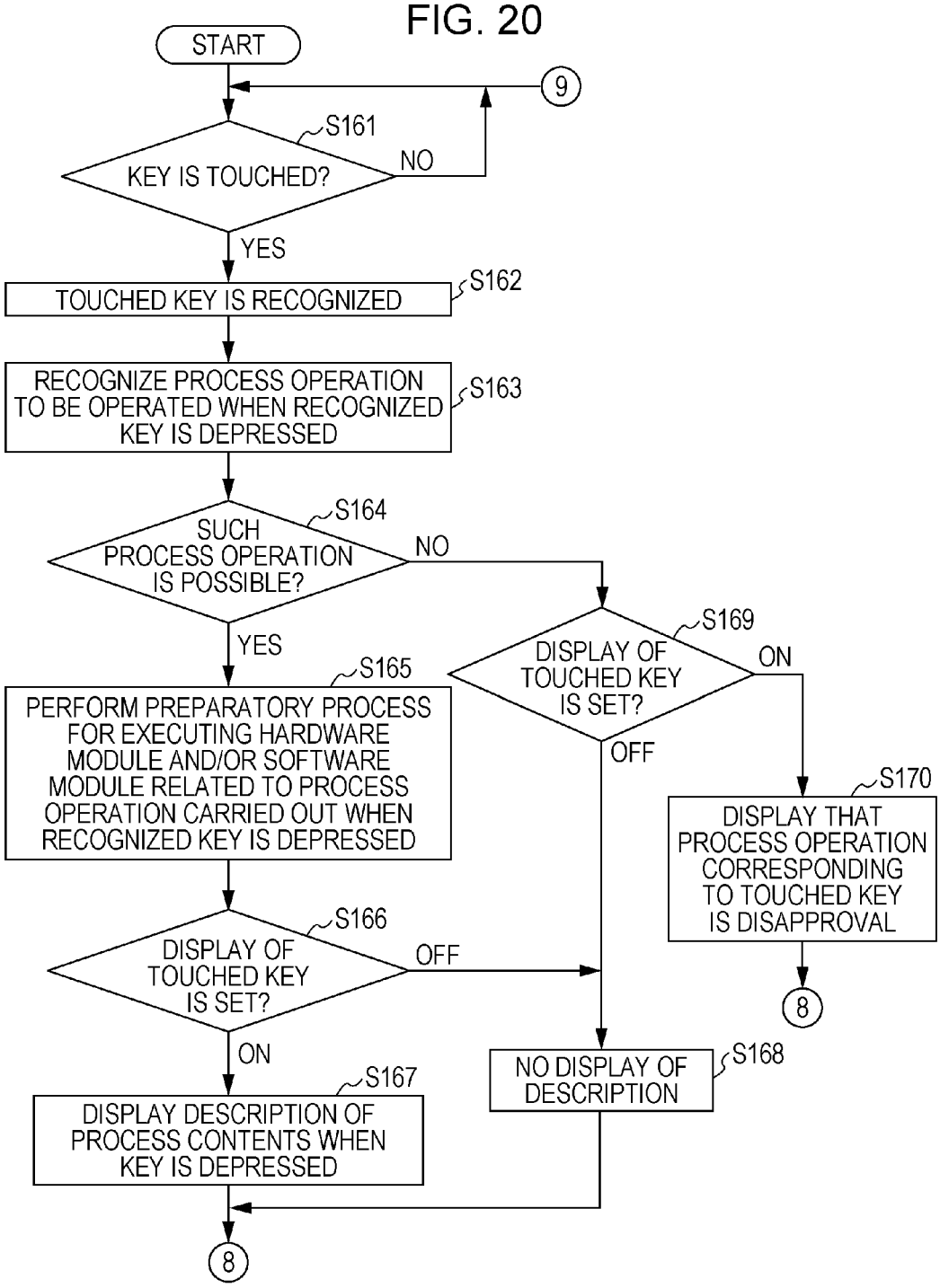
FIG. 20 is a diagram illustrating part of the flow chart of the main processing operation of the electronic apparatus according to the third embodiment of the present invention.

In the third embodiment, referring now to a flow chart illustrated in FIG. 20 and FIG. 21, the processing operation of the control unit 50 will be described. Here, the key operation unit 53 is operated with a process explanation display in consideration of the above description. An example shown in FIG. 20 and FIG. 21 allows for a previous user setting to determine whether a process explanation display is performed (setting of display ON or display OFF).

First, the control unit 50 monitors whether any of operation keys on the key operation unit 53 is touched (Step S161). If it is determined that the operation key is touched in step S161, then the control unit 50 recognizes the touched operation key (Step S162). Next, the control unit 50 recognizes a processing operation to be executed upon depression of the recognized operation key (Step S163).

Next, the control unit 50 determines whether a processing operation to be executed when the recognized operation key is depressed is executable (Step S164). As is exemplified in the above description, the determination process in step S164 is performed in the electronic apparatus with reference to the state at that time, information recorded in replaying contents at that time, or the like.

In step S164, if the control unit 50 determines that the processing operation is executable, the control unit 50 performs an execution preparatory process for a hardware module and/or software related to the recognized processing operation (Step S165).

Next, the control unit 50 determines whether the display setting about a process explanation display for the touched operation key is display ON or display OFF (Step S165). Subsequently, if the control unit 50 determines that the display setting is "display ON", a process explanation display that shows the contents of processing when the touched operation key is depressed is read from the storage unit as described above, and then displayed on the screen of the display 55 (Step S167).

Furthermore, in step S166, if the control unit 50 discriminates that the display setting is "display OFF", then the control unit 50 does not perform any process explanation display (Step S168).

Furthermore, in step S164, if the control unit 50 discriminates that control processing operation is not executable, then the control unit 50 does not execute any execution preparatory process such as one performed in step S165.

Furthermore, the control unit 50 discriminates whether the display setting about a process explanation display for the touched operation key is "display ON" or "display OFF" (Step S165).

In step s169, if the control unit 50 discriminates that the display setting is "display ON", then the control unit 50 displays a process explanation display, "Control processing corresponding to touched operation key is not executable" (Step S170). Furthermore, in step S170, even if the touched operation key is depressed, a process explanation display, "This operation is ineffective", may be displayed at this operation.

Furthermore, in step S169, if the control unit 50 discriminates that the display setting is "display OFF", then the control unit 50 does not perform any process explanation display and the process proceeds to step S168.

Figure 21:
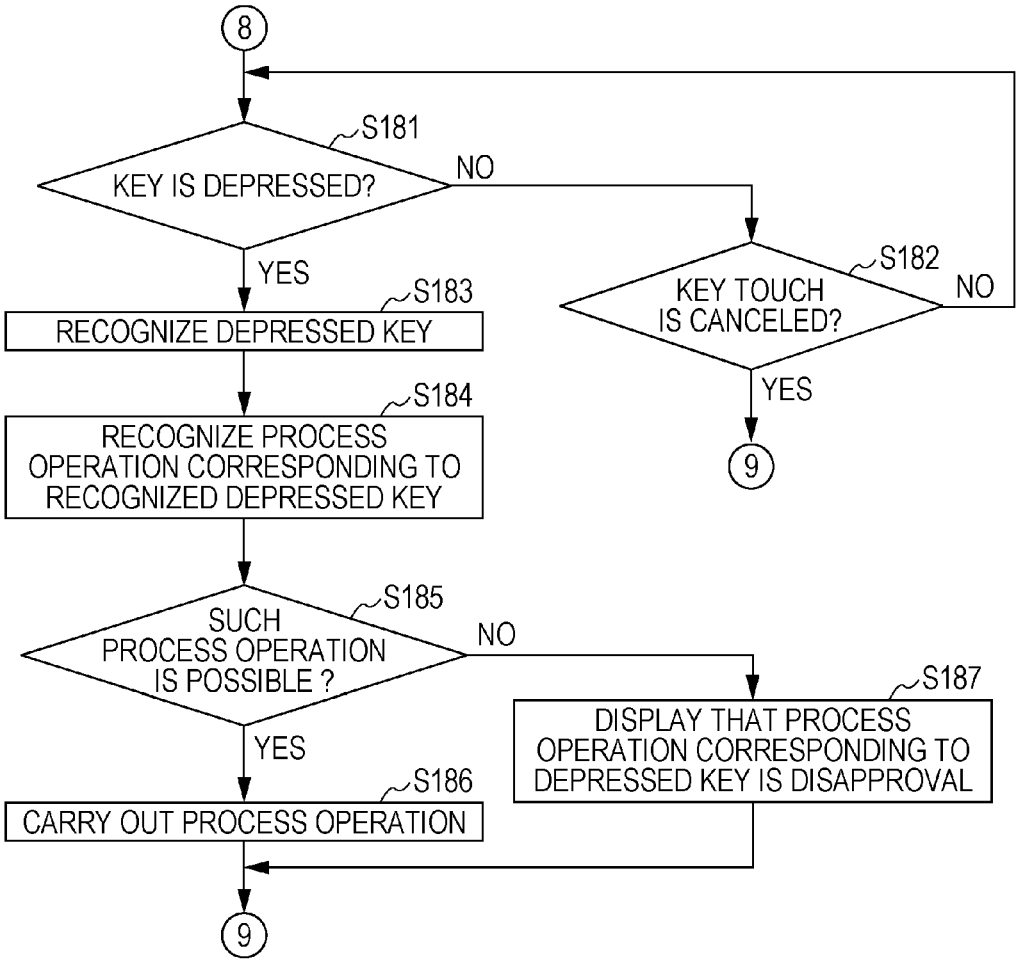
FIG. 21 is a diagram illustrating part of the flow chart of the main processing operation of the electronic apparatus according to the third embodiment of the present invention.

The process proceeds from step S167, step S168, and step S170 to step S181 shown in FIG. 21 and the control unit 50 discriminates whether any of operation keys is depressed. Furthermore, in step S181, if the control unit 50 discriminates that the operation key is not depressed, then the control unit 50 discriminates whether the operation key currently touched is no longer touched (Step S182).

In step S182, if the control unit 50 discriminates that the operation key is still being touched, then the process returns to step S181 and the control unit 50 monitors the depression of operation keys. In addition, in step S182, if the control unit 50 discriminates that the operation key is no longer touched, then the process returns to step S161 and steps subsequent to step S161 are repeated.

Furthermore, if it is discriminated that the operation key is depressed in step S181, then the control unit 50 recognizes the depressed operation key (Step S183).

Next, the control unit 50 recognizes a processing operation corresponding to the depressed operation key (Step S184).

Next, the control unit 50 discriminates whether a processing operation corresponding to a depressed operation key is executable (Step S185). In a manner similar to step S164, the discriminates process in step S185 is performed in the electronic apparatus with reference to the state at that time, information recorded in replaying contents at that time, or the like.

In step S185, if it is discriminated that a processing operation is executable, the control unit 50 performs the processing operation by generating a process execution control signal and then supplies such a signal to a hardware module and/or software related to the processing operation (Step S186).

Subsequently, the process returns to step S161 and then the subsequent steps are repeated.

Furthermore, in step S185, if it is discriminated that the processing operation is executable, then the control unit 50 does not perform the execution control of the processing operation and then displays a process explanation display, "Control processing corresponding to operation key is not executable" (Step S187) is displayed on the screen as a process explanation display. Furthermore, in step S187, even if the touched operation key is depressed, a process explanation display, "This operation is ineffective", may be displayed at this operation.

Subsequently, the process returns to step S161 and then the subsequent steps are repeated.

In the above example, when an operation key is depressed and a processing operation corresponding to the operation key is not executable, the display setting of the process explanation display is not referenced while a message of indicating that the processing operation corresponding to the operation key is not executable is allowed to be displayed.

Alternatively, it may be discriminated how the display setting of the process explanation display is defined between step S185 and step S187. The above message of "not executable" may be displayed only at the time of "display ON". However, if the processing is not performed even if the operation key is depressed, the user may mix with failure. Thus, like the above example, it is better to display the above message of "not executable" regardless of display setting when the operation key is depressed.

The exemplary processing operation for the process explanation display has been described with respect to the electronic apparatus 5 of the third embodiment. However, it will be appreciated that the above exemplary processing operation for the process explanation display is also applicable when the electronic apparatus receives a remote-control signal corresponding to an operation key of the remote-control transmitter according to the first embodiment as described above.

Fourth Embodiment

In any of the aforementioned embodiments, operation keys are mechanical push button keys.

However, any of embodiments of the present invention may employ icons (symbols or graphic representation) displayed on the screen. That is, any of icons is selected by a mouse and determined by clicking the mouse button to activate a hardware module and/or a software module corresponding to the icon.

Figure 22:
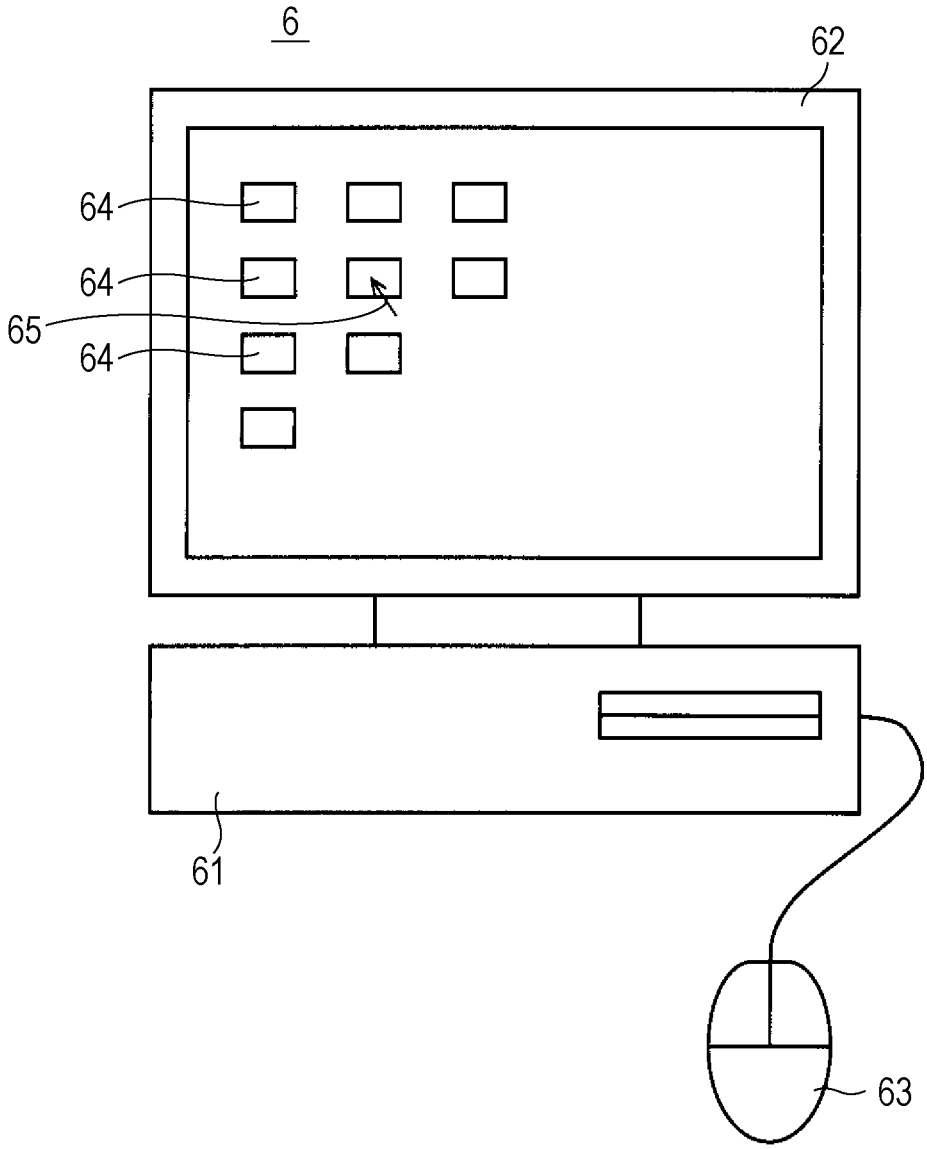
FIG. 22 is a schematic diagram illustrating an exemplary configuration of an electronic apparatus in accordance with a fourth embodiment of the present invention.

FIG. 22 is a diagram illustrating a personal computer 6 as an electronic apparatus of the fourth embodiment. The personal computer 6 of the present invention includes a main body 61, a display monitor 62, and a pointing device (mouse) 63.

As shown in the figure, icons 64, 64, . . . are displayed on a display monitor 62. The user may select any of icons 64, 64, . . . by a mouse cursor 65 and click the mouse on the mouse 63, thereby activating the corresponding hardware module and/or software module.

In this embodiment, a state in which the mouse cursor 65 is located on the display area of any of icons 64 is determined as a state in which the icon 64 of interest is being selected. This state corresponds to the state in which the operation key is being touched in any of the aforementioned embodiments.

Furthermore, the electric apparatus of the embodiment may be designed so that an execution preparatory control for a hardware module and/or a software module in any of the aforementioned embodiments is performed when such a state in which any of icons 64 is being selected.

Furthermore, in the state that any of icons is being selected, the electronic apparatus of the present embodiment determines that the click of the mouse is an operation of concluding the selection of the icon. Furthermore, if it is determined that the operation of concluding the selection of the icon is performed, the electronic apparatus of the present embodiment is designed to activate a hardware module and/or a software module corresponding to the icon.

Figure 23:
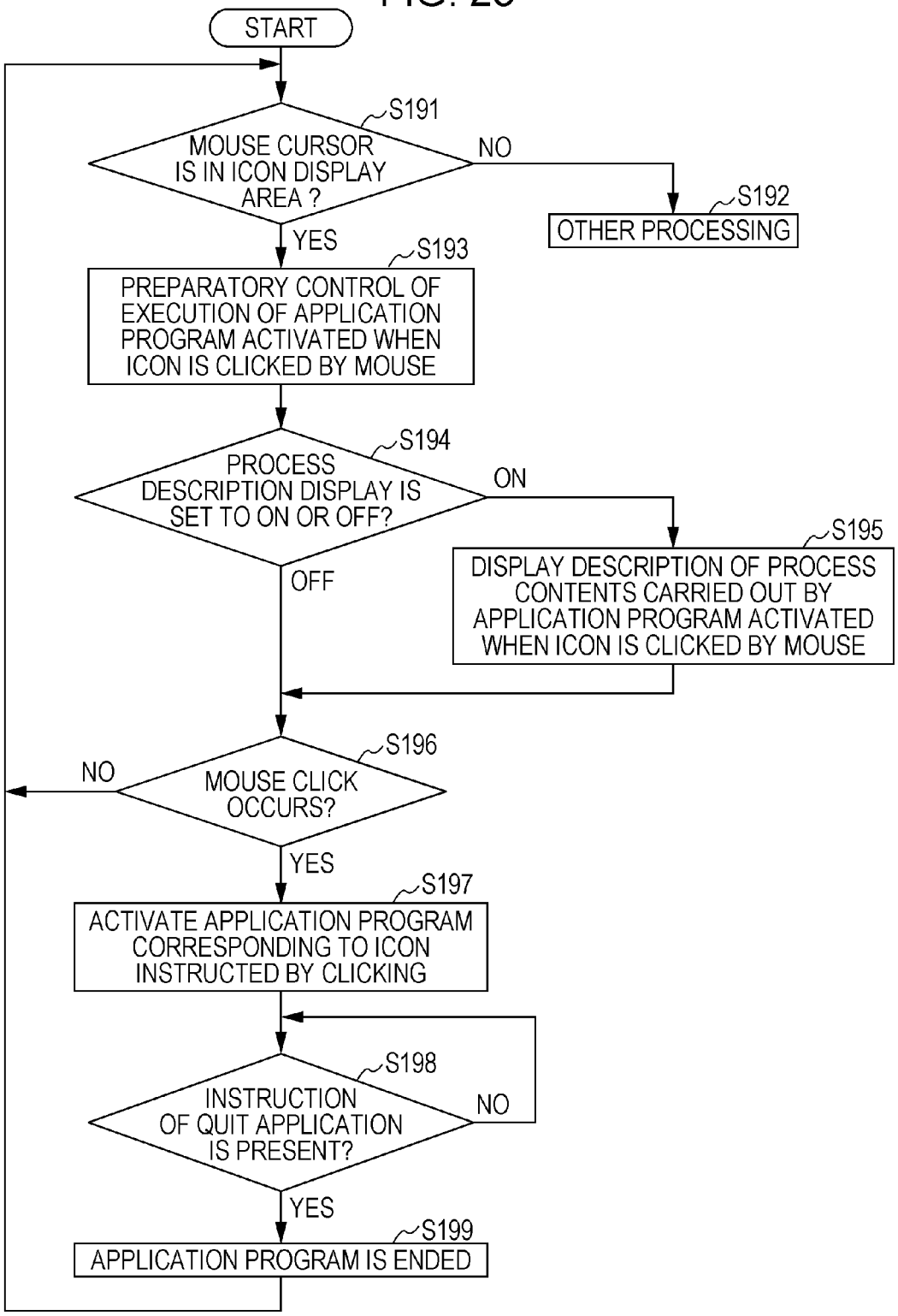
FIG. 23 is a diagram illustrating a flow chart of an exemplary processing operation of the electronic apparatus according to the fourth embodiment of the present invention.

FIG. 23 illustrates a flow chart of a processing operation performed in the electronic apparatus of the fourth embodiment. In an example shown in FIG. 23, only a software module (application program) is activated corresponding to an icon. Furthermore, each step of the flow chart is performed by executing a program for the processing operation by the central processing unit (CPU) of the main body 61 of the personal computer.

Furthermore, when a cursor is located within the display area of the icon 64, an example shown in FIG. 23 allows for a previous user setting to discriminate whether a process explanation display is performed (setting of display ON or display OFF).

First, the CPU discriminates whether the mouse cursor 65 is located within the display area of any of icons 64 (Step S191). The discrimination of whether the mouse cursor 65 is located within the display area of any of icons 64 is based on whether the mouse cursor stays within the display area of the icon 64 for a predetermined time or more so as to not detect that the mouse cursor just passes through the display area of the icon 64.

In step S191, if it is discriminated that the mouse cursor is not located within the display area of any of icons 64, then the CPU performs another processing (Step S192).

In step S191, if it is determined that the mouse cursor 65 is located within the display area of any of icons 64, then the CPU performs execution preparatory control of an application program which is activated when the mouse clicks the icon (Step S193). The execution preparatory control of this application program is the same as that of the execution preparatory control of the software module in any of the aforementioned embodiments.

Next, the CPU determines whether the display setting about a process explanation display is "display ON" or "display OFF" when the cursor is located within the display domain of any of icons 64 (Step S194). Subsequently, if the CPU determines that the display setting is "display ON", then a process explanation display is displayed on the screen of the display monitor 62. Here, the process explanation display represents the processing contents of an application program to be activated by clicking the icon where the cursor is located (Step S195).

Furthermore, in step S194, if it is determined that the display setting is "display OFF", then the CPU does not perform a process explanation display but determines whether the mouse 63 is clicked in a state of selecting the icon (Step S196).

In this step S196, if it is discriminated whether the mouse 63 does not click any of icons, then the process returns to step S191.

Furthermore, in step S196, if the mouse 63 clicks the icon 64, then an application program that corresponds to the icon indicated by clicking is activated (Step S197).

Subsequently, the CPU waits for instructions of ending the application program activated in step S197 (Step S198). Subsequently, in step S197, if the activated application program is instructed to be ended, then the CPU completes the ending of the application program (Step S199). Then, the process returns to step S191.

Therefore, the fourth embodiment is advantageous to accelerate the activation of an application program.

Furthermore, the example shown in FIG. 23 is based on that the application program is executable. However, under any of various conditions, the application program may not be activated just as in the case with the aforementioned third embodiment. Therefore, it will be appreciated that a processing example of the process explanation display shown in FIG. 18 and FIG. 19 may be applied to the fourth embodiment.

OTHER EMBODIMENTS OR MODIFIED EXAMPLES

First Modified Example

In any of the aforementioned first to third embodiments, a touch sensor is attached on the surface of each operation key. Thus, touching the touch sensor allows for detecting that the user touches the operation key. However, detection of touching the operation key is not restricted to this example.

In Japanese Published Patent Application No. 2008-117371, the applicant of the invention discloses the detection of the fingertip of the user in the space above the panel of a touch sensor.

Figure 24:
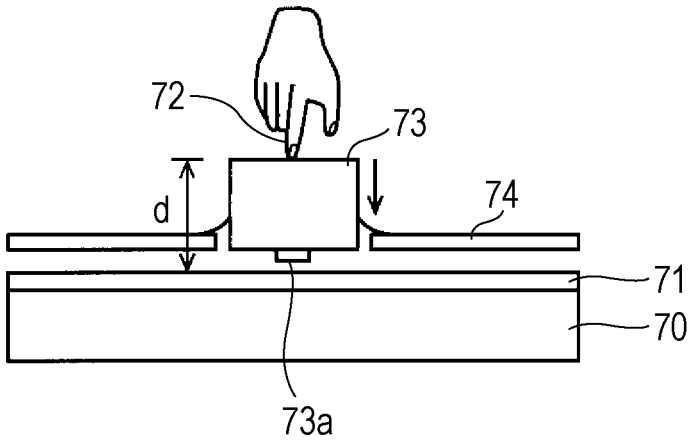
FIG. 24 is a schematic diagram illustrating another exemplary configuration of a key operation unit used in the electronic apparatus in accordance with any embodiment of the present invention.

In Japanese Published Patent Application No. 2008-117371, for example, an electrode panel that forms a touch panel 71 on a substrate 70 is disclosed in FIG. 24. Furthermore, a change in electric capacity between the electrodes of an electrode panel 71 occurs depending on the distance d between two electrodes of the electrode panel 71 when the fingertip 72 of the user is placed in the upper space of the electrode panel 71.

Figure 25:
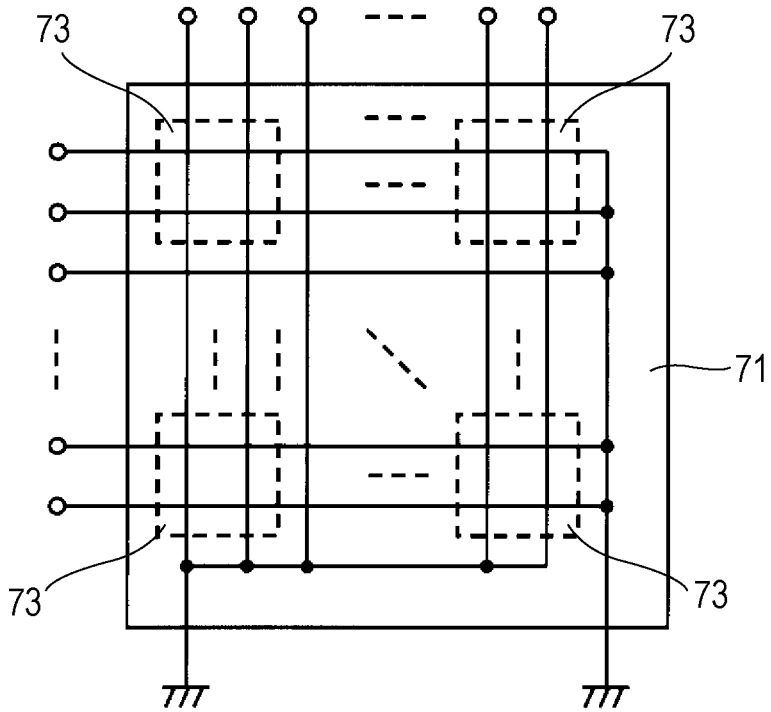
FIG. 25 is a schematic diagram illustrating another exemplary configuration of a key operation unit used in the electronic apparatus in accordance with any embodiment of the present invention.

The electrode panel 71 may be one illustrated in FIG. 25 and includes two or more panels in horizontal direction and two or more panels in vertical direction.

Here, as shown in FIG. 25, operation keys may be arranged as shown in FIG. 24 on a position represented by dotted lines. The operation key 73 may be attached on the operation key supporting member 74*b* through a biasing device 75 in the vertical direction. A bore is formed in the operation key supporting member 74 so that the operation key 73 can be depressed in the vertical direction. A projected part 73*a* is formed on the bottom surface of an operation key 73. The projected part 73*a* is responsible for detecting the depression of the operation key as a touch when the depression of the operation key 73 pushes down an electrode panel (touch panel) 71.

In such a structure, furthermore, an electrostatic capacity value to be detected is set as an electrostatic capacity value at the distance d between the electrode panel 71 and the surface of the operation key 73. In this way, it can be determined whether the user touches the operation key by detecting whether an electrostatic capacity value exceeds the preset value. Furthermore in the above patent document, the electrostatic capacity value obtained between two electrodes of the electrode panel is configured as a capacity of a resonant circuit of an oscillating circuit and obtainable as a change in oscillating frequency of the oscillating circuit.

In FIG. 25, the number of oscillating circuits for outputting oscillating frequency in response to the electrostatic capacity between two electrodes in the horizontal direction may correspond to the number of electrodes in the horizontal direction. In addition, the number of oscillating circuits for outputting oscillating frequency in response to the electrostatic capacity between two electrodes in the vertical direction may correspond to the number of electrodes in the vertical direction.

Furthermore, any of the oscillation circuits can detect whether any of operation keys is being touched by detecting an oscillating frequency depending on the established electrostatic capacity.

Modified Example 2

Figure 26:
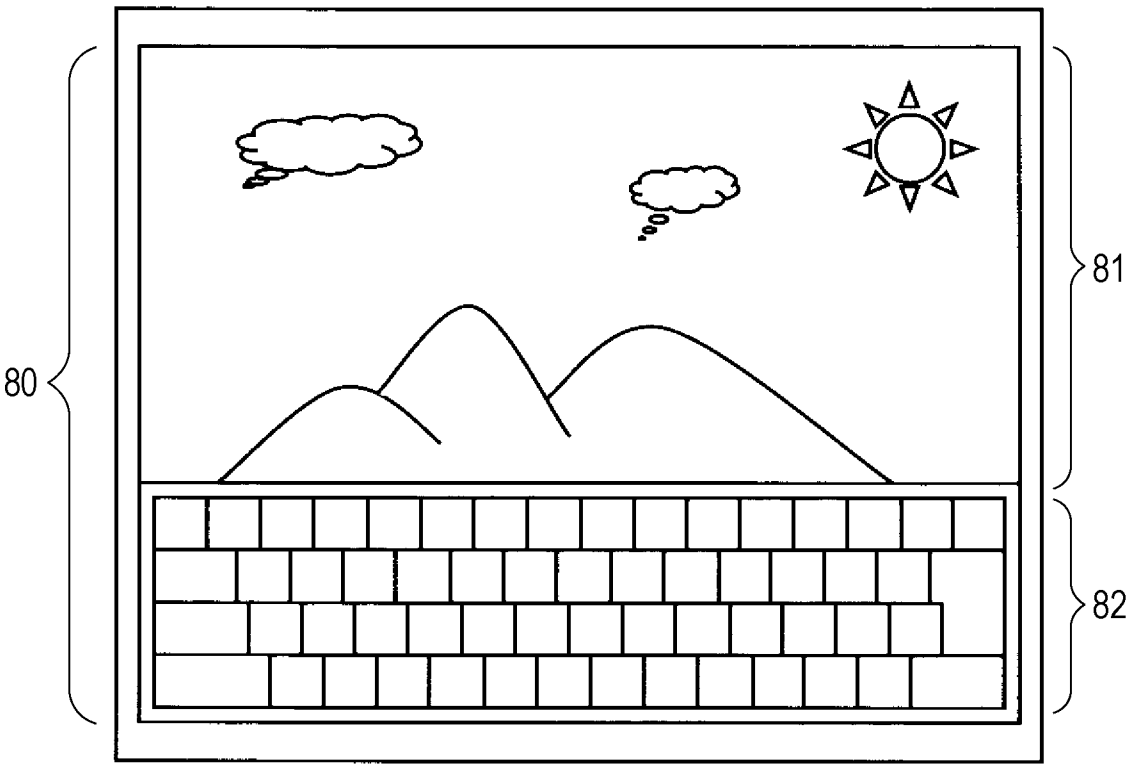
FIG. 26 is a schematic diagram illustrating another exemplary configuration of a key operation unit used in the electronic apparatus in accordance with any embodiment of the present invention.

In the fourth embodiment, the operation of icons, which are displayed on the display screen where an image is displayed, is designed to correspond to operation keys in the present embodiment of the invention. In contrast, as shown in FIG. 26, a display screen 80 is divided into two regions, a display region 81 for images or the like and a display region 82 for operation key. In addition, the display region 82 for operation key may be designed to display only a plurality of operation keys. Furthermore, the operation of a mouse about each of operation keys displayed on the operation-key display region 82 may be performed in a manner similar to the operation of icons in the above fourth embodiment.

In this case, furthermore, the operation-key display region 82 may be provided with a touch panel such as one described in FIG. 24 and FIG. 25. In this case, if the fingertip of the user is closed to a space apart from the screen with a distance of d, then it is determined that each of operation keys being displayed is selected. Furthermore when the user touches the operation key on the surface screen, it may be discriminated from the determination operation in selective state. Furthermore, in stead of dividing into a region 81 for displaying an image or the like and a region 82 for displaying operation keys on the display screen 80, an operation-key display region may be formed on another region or another body.

Other Modified Examples

The electronic apparatus according to any of the aforementioned embodiments may be a complex electronic apparatus provided with functions of a plurality of electronic apparatuses. In this embodiment, it is not limited to such a complex electronic apparatus. Alternatively, it will be appreciated that an electronic apparatus with a single function may be applicable. In this case, one or two or more hardware modules and/or software modules for executing the single function are targets of preparation execution processing. Furthermore, in each of the first and second embodiment as described above, the key operation unit of the remote-control transmitter is configured to be mechanically depressible. Alternatively, an operation key input device may be a combination of a touch panel and display elements in a manner similar to the above display region 82 for operation keys.

Any of the aforementioned embodiments has been described such that different functions for the respective modes are assigned to the operation keys corresponding to a plurality of modes. Alternatively, each of the operation keys may be provided with an additional function of the same mode. For example, in the case of a video tape recorder (VTR), a fast-forward key or a fast-rewind key are depressed when a video tape is in halt state to wind the tap fast or wind the tape back. At the time of playing the video tape, key depression leads to a so-called picture search mode in which the tape is fast forwarded or rewound while images are replayed at high speed on the screen.

Furthermore, a process explanation display when the user touches an operation key may include not only the description about the contents of the processing operation but also the description reflecting an operation history. For example, when the user touches a program key, a message of process explanation display, "Reserve program", is displayed on the display as long as a program reservation is possible. However, in the case of being difficult to reserve a program anymore because of a large number of the reserved programs and an overfilling of storage capacity for reservations, a message of process explanation display such as "no more reservation because of filled reservation list" is displayed on the screen of the display.

In addition to the processing explanation display or instead of process explanation display, the contents of process explanation may be spoken or the user may be informed of such contents.

Furthermore, the electronic apparatus of any of the aforementioned embodiments have their own displays except for the personal computer of the fourth embodiment. However, the display may be independent like the personal computer. If the display is independent, the electronic apparatus is provided with a structural component for supplying display information for process explanation display. Here, the structural component may be a display signal generator, a generator for display signal output, and so on.

The present application contains subject matter related to that disclosed in Japanese Priority Patent Application JP 2008-257975 filed in the Japan Patent Office on Oct. 3, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

WHAT IS CLAIMED IS:

The invention claimed is:

1. An electronic apparatus, comprising:

a remote-control signal transmitter having a plurality of operation keys; and an electronic apparatus body that receives said remote-control signal from said transmitter, wherein said remote-control signal transmitter includes:

means of first detection for detecting a touch at an operation key among said plurality of operation keys;

means of second detection for detecting an operation key on which an operation of changing a state is performed;

means of generating a first remote-control signal including information for identifying said operation key at which a touch occurs based on a detection result of said means of first detection and information for indicating that said operation key is being touched;

means of generating a second remote-control signal including information for identifying said operation key on which an operation of changing a state is performed based on a detection result of said means of second detection and information for indicating that the state of said operation key is changed; and means of transmitting said first remote-control signal and said second remote-control signal to said electronic apparatus body, and said electronic apparatus body includes:

means of reception for receiving said first remote-control signal and said second remote-control signal from said remote-control signal transmitter;

means of operation key recognition for recognizing information for identifying said operation key from said first remote-control signal or said second remote-control signal received by said means of reception;

means of recognizing a key operation state for recognizing, from said first remote-control signal or said second remote-control signal received by said means of reception, whether a state of the operation key recognized by said means of operation key recognition is changed;

means of identifying a processing operation that would be performed by the electronic apparatus body in response to a change in state of the operation key recognized by said means of operation key recognition from said first remote-control signal, wherein the means of identifying identifies, in a case that the operation key recognized by the means of operation key recognition from said first remote-control signal corresponds to a plurality of processing operations, a processing operation that would be performed by the electronic apparatus body in response to a change in state of the operation key at a time that the means of operation key recognition recognizes the operation key from said first remote-control signal, the electronic apparatus body being configured to perform different processing operations of the plurality of processing operations in response to a change in state of the operation key recognized from said first remote-control signal when the electronic apparatus body is operated in different modes;

means of generating, in response to said means of recognizing a key operation state recognizing that said operation key is touched, a notification signal for notifying a user about the processing operation that would be performed at the time in response to a change in state of the operation key recognized by said means of operation key recognition from said first remote-control signal; and means of first control for controlling, in response to said means of recognizing a key operation state recognizing that the state of said operation key is changed, a hardware module and/or a software module associated with said operation key recognized by said means of operation key recognition from said second remote-control signal.

2. The electronic apparatus according to claim 1, wherein a touch sensor for detecting a state of being touched by said user is formed on the surface of each of said plurality of operation keys, and said means of first detection detects a touch at an operation key from detection outputs of said touch sensors of said plurality of operation keys.

3. The electronic apparatus according to claim 1, wherein a touch sensor for detecting a state of being touched with said user by a change in electrostatic capacity is formed on the surface of each of said plurality of operation keys, and said means of first detection detects a touch at an operation key from the detection output of said touch sensor.

4. The electronic apparatus according to claim 1, wherein said means of generating a notification signal generates a display signal that displays an explanation message about said processing on a display screen as said notification signal.

5. The electronic apparatus according to claim 1, wherein said means of generating a notification signal generates an audio signal of an explanation message about said processing as said notification signal.

6. The electronic apparatus according to claim 1, further comprising:

means of determination for determining an operation key to be subjected to an operation of changing said state from an arrangement of a plurality of operation keys currently touched when said plurality of operation keys is currently touched.

7. The electronic apparatus according to claim 1, further comprising:

means of discrimination for discriminating whether a process corresponding to said operation key recognized by said means of operation key recognition is executable, wherein said means of generating a notification signal notifies as an explanation of said process that said process corresponding to said operation key is not executable when said means of discrimination discriminates that said process is not executable.

8. The electronic apparatus according to claim 1, further comprising:

means of second control for controlling a hardware module and/or a software module corresponding to said operation key recognized by said means of operation key recognition when said means of recognizing a key operation state recognizes that said operation key is touched.

9. An electronic apparatus, including:

an electronic apparatus body;

means of first detection for detecting a touch at an operation key among a plurality of operation keys;

means of second detection for detecting an operation key on which an operation of changing a state is performed;

means of generating a first remote-control signal including information for identifying said operation key at which a touch occurs, based on a detection result of said means of first detection and information for indicating that said operation key is being touched;

means of generating a second remote-control signal which generates a second remote-control signal including information for identifying said operation key on which an operation of changing a state is performed based on a detection result of said means of second detection and information for indicating that the state of said operation key is changed; and means of transmitting said first remote-control signal and said second remote-control signal to said electronic apparatus body;

wherein the electronic apparatus body is configured to receive said remote-control signal and comprises:

means of reception for receiving said first remote-control signal and said second remote-control signal from said remote-control signal transmitter;

means of operation key recognition for recognizing information for identifying said operation key from said first remote-control signal or said second remote-control signal received by said means of reception;

means of recognizing a key operation state for recognizing, from said first remote-control signal or said second remote-control signal received by said means of reception, whether a state of an operation key recognized by said means of operation key recognition is changed;

means of identifying a process that would be performed by the electronic apparatus body in response to a change in state of the operation key recognized by the means of operation key recognition from said first remote-control signal, wherein the means of identifying identifies, in a case that the operation key recognized by the means of operation key recognition from said first remote-control signal corresponds to a plurality of processes, a process that would be performed by the electronic apparatus body in response to a change in state of the operation key at a time that the means of operation key recognition recognizes the operation key from said first remote-control signal, the electronic apparatus body being configured to perform different processes of the plurality of processes in response to a change in state of the operation key when the electronic apparatus body is operated in different modes;

means of generating, in response to said means of recognizing a key operation state recognizing that said operation key is touched, a notification signal for notifying a user about the process that would be performed at the time in response to a change in state of the operation key recognized by said means of operation key recognition from said first remote-control signal; and means of first control for controlling, in response to said means of recognizing a key operation state recognizing that the state of said operation key is changed, a hardware module and/or a software module associated with said operation key recognized by said means of operation key recognition from said second remote-control signal.

10. An electronic apparatus, comprising:

a plurality of operation keys;

means of first detection for detecting a touch at an operation key among said plurality of operation keys;

means of second detection for detecting an operation key on which an operation of changing a state is performed;

means of identifying a process that would be performed by the electronic apparatus in response to a change in state of the operation key at which the means of first detection detects a touch, wherein the means of identifying identifies, in a case that the operation key at which the means of first detection detects the touch corresponds to a plurality of processes, a process that would be performed by the electronic apparatus in response to a change in state of the operation key in a mode of a plurality of modes in which the electronic apparatus is operated at a time that the means of first detection detects the touch at the operation key, the electronic apparatus being configured to perform different processes of the plurality of processes in different modes of the plurality of modes in response to a change in state of the operation key at which the means of first detection detects the touch;

means of generating a notification signal for notifying a user about the process that would be performed at the time in response to a change in state of said operation key at which the touch is detected, based on a result from said means of first detection; and means of first control for controlling a hardware module and/or a software module associated with said operation key on which an operation of changing a state is performed to a running state, based on a detection result of said means of second detection.

11. A method of controlling an electronic apparatus that includes a plurality of operation keys, means of first detection, means of second detection, means of generating a notification signal, and means of first control, comprising the steps of:

detecting a touch at an operation key among said plurality of operation keys;

detecting an operation key on which an operation of changing a state is performed;

identifying a process that would be performed by the electronic apparatus in response to a change in state of the operation key at which the touch is detected, wherein the operation key detected to have been touched corresponds to a plurality of processes and the identifying comprises identifying a process of the plurality of processes that would be performed by the electronic apparatus in response to a change in state of the operation key at a time that the touch of the operation key is detected, the electronic apparatus being configured to perform different processes of the plurality of processes in response to a change in state of the operation key when the electronic apparatus is operated in a first mode and when the electronic apparatus is operated in a second mode;

generating a notification signal for notifying a user of explanation about the process that would be performed at the time in response to a change in state of said operation key at which a touch occurs, based on a detection result of said detecting; and controlling a hardware module and/or a software module associated with said operation key on which an operation of changing a state is performed to a running state by said means of first control, based on a detection result of said detecting.

12. A method of controlling an electronic apparatus, where said electronic apparatus includes a remote-control signal transmitter having a plurality of operation keys, means of first detection, means of second detection, means of generating a first remote-control signal, means of generating a second remote-control signal, and means of transmitting a remote-control signal, and an electronic apparatus body, which receives said remote-control signal from said transmitter, including means of reception, means of operation key recognition, means of recognizing a key operation state, means of generating a notification signal, and means of control, wherein the method comprises acts, carried out by said transmitter, of:

detecting a touch at an operation key among said plurality of operation keys;

detecting an operation key on which an operation of changing a state is performed;

generating a first remote-control signal containing information for identifying said operation key at which a touch occurs, based on a detection result of said act of first detection and information for indicating that said operation key is being touched;

generating a second remote-control signal comprising information for identifying said operation key on which an operation of changing a state is performed based on a detection result of said detecting of an operation key on which the operation of changing a state is performed; and transmitting said first remote-control signal and said second remote-control signal to said electronic apparatus body, and the method comprises acts carried out by said electronic apparatus body, of:

receiving said first remote-control signal and said second remote-control signal from said transmitter;

recognizing information for identifying said operation key from said first remote-control signal or said second remote-control signal received;

recognizing a key operation state for recognizing, from said first remote-control signal or said second remote-control signal received by said receiving, whether a state of an operation key recognized in the recognizing is changed;

identifying a process that would be performed by the electronic apparatus body in response to a change in state of the operation key at which the touch is detected, wherein the operation key detected to have been touched corresponds to a plurality of processes and the identifying comprises identifying a process that would be performed by the electronic apparatus body in response to a change in state of the operation key at a time that the operation key is recognized from said first remote-control signal, the electronic apparatus body being configured to perform a first process of the plurality of processes in response to a change in state of the operation key when the electronic apparatus body is operated in a first mode and is configured to perform a second process of the plurality of processes in response to a change in state of the operation key when the electronic apparatus body is operated in a second mode;

generating a notification signal for notifying a user of explanation about the process that would be performed at the time in response to a change in state of an operation key recognized by the recognizing when said operation key is touched; and controlling a hardware module and/or a software module associated with said operation key recognized by said step of operation key recognition when the state of said operation key is changed.

13. A computer storage apparatus having a program stored therein for receiving a remote-control signal in an electronic apparatus, wherein the electronic apparatus includes means of first detection for detecting a touch at an operation key among a plurality of operation keys; means of second detection for detecting an operation key on which an operation of changing a state is performed; means of generating a first remote-control signal containing information for identifying said operation key at which a touch occurs based on a detection result of said means of first detection and information for indicating that said operation key is being touched; means of generating a second remote-control signal which generates a second remote-control signal including information for identifying said operation key on which an operation of changing a state is performed based on a detection result of said means of second detection and information for indicating that the state of said operation key is changed; and means of transmitting said first remote-control signal from said means of generating a first remote-control signal and said second remote-control signal from said means of generating a second remote-control signal to an electronic apparatus body, and wherein, to control said electronic apparatus in response to said remote-control signal from a remote-control transmitter, the program causes a computer to function as:

means of operation key recognition for recognizing said operation key from said first remote-control signal or said second remote-control signal received by means of reception for receiving said first remote-control signal and said second remote-control signal from said transmitter;

means of recognizing a key operation state for recognizing, from said first remote-control signal or said second remote-control signal received by said means of reception, whether a state of an operation key recognized by said means of operation key recognition is changed;

means of identifying a process that would be performed by the electronic apparatus in response to a change in state of the operation key recognized by the means of operation key recognition from the first remote-control signal, wherein the means of identifying identifies, in a case that the operation key recognized by the means of operation key recognition from said first remote-control signal corresponds to a plurality of processes, a process that would be performed by the electronic apparatus in response to a change in state of the operation key at a time that the means of operation key recognition recognizes the operation key from said first remote-control signal, the electronic apparatus being configured to perform different processes of the plurality of processes in response to a change in state of the operation key detected from the first remote-control signal when the electronic apparatus is operated in different modes;

means of generating, in response to said means of recognizing a key operation state recognizing that said operation key is touched, a notification signal for notifying a user about the process that would be performed at the time in response to a change in state of the operation key recognized by said means of operation key recognition from said first remote-control signal; and means of control for controlling, in response to said means of recognizing a key operation state recognizing that the state of said operation key is changed, a hardware module and/or a software module associated with said operation key recognized by said means of operation key recognition from said second remote-control signal.

14. A computer storage apparatus having a program stored therein for an electronic apparatus, wherein in order to control said electronic apparatus in response to an operation input from a user to a plurality of operation keys, the program, when executed by a computer, causes the computer to function as:

means of first detection for detecting a touch at an operation key among said plurality of operation keys;

means of second detection for detecting an operation key on which an operation of changing a state is performed;

means of identifying a process that would be performed by the electronic apparatus in response to a change in state of the operation key at which the touch is detected by the means of first detection, wherein the means of identifying identifies, in a case that the operation key at which the touch is detected corresponds to a plurality of processes, a process that would be performed by the electronic apparatus in response to a change in state of the operation key in a mode in which the electronic apparatus is operated when the touch is detected at the operation key by the means of first detection, the electronic apparatus being configured to perform different processes of the plurality of processes in response to a change in state of the operation key at which the touch is detected by the means of first detection when the electronic apparatus is operated in different modes;

means of generating a notification signal for notifying a user about process that would be performed in the mode in response to a change in state of said operation key at which the touch is detected, based on a detection result of said means of first detection; and means of control for controlling a hardware module and/or a software module associated with said operation key on which an operation of changing a state is performed to a running state is included, based on a detection result of said means of second detection.

15. An electronic apparatus, comprising:

a remote-control signal transmitter having a plurality of operation keys; and an electronic apparatus body that receives said remote-control signal from said transmitter, wherein said remote-control signal transmitter includes:

a first detector unit for detecting a touch at an operation key among said plurality of operation keys;

a second detector unit for detecting an operation key on which an operation of changing a state is performed;

a generator unit for generating a first remote-control signal including information for identifying said operation key at which a touch occurs based on a detection result of said first detector unit and information for indicating that said operation key is being touched;

a generator unit for generating a second remote-control signal including information for identifying said operation key on which an operation of changing a state is performed based on a detection result of said second detector and information for indicating that the state of said operation key is changed; and a transmitter unit for transmitting aid first remote-control signal and said second remote-control signal to said electronic apparatus body, and said electronic apparatus body includes:

a receiver unit for receiving said first remote-control signal and said second remote-control signal from said remote-control signal transmitter;

an operation key recognizer unit for recognizing information for identifying said operation key from said first remote-control signal or said second remote-control signal received by said receiver unit;

a key operation state recognizer unit for recognizing, from said first remote-control signal or said second remote-control signal received by said receiver unit, whether a state of an operation key recognized by said operation key recognizer unit is changed;

an identification unit for identifying a processing operation that would be performed by the electronic apparatus body in response to a change in state of the operation key, wherein the identification unit identifies, in a case that the operation key recognized by the operation key recognizer unit from said first remote-control signal corresponds to a plurality of processing operations, a processing operation that would be performed by the electronic apparatus body in response to a change in state of the operation key in an operating state in which the electronic apparatus body is operated when the operation key recognizer unit recognizes the operation key from said first remote-control signal, the electronic apparatus body being configured to perform different processing operations of the plurality of processing operations in response to a change in state of the operation key detected from the first remote-control signal when the electronic apparatus body is operated in different operating states;

a generator unit for generating, in response to said key operation state recognizer unit recognizing that said operation key is touched, a notification signal notifying a user about a processing operation that would be performed in the operating state in response to a change in state of the operation key recognized by said operation key recognizer unit from said first remote-control signal; and a first control unit for controlling, in response to said key operation state recognizer unit recognizing that the state of said operation key is changed, a hardware module and/or a software module associated with said operation key recognized by said operation key recognizer unit from said second remote-control signal.

16. The electronic apparatus according to claim 15, wherein a touch sensor for detecting a state of being touched by said user is formed on the surface of each of said plurality of operation keys, and said first detector unit detects said operation key at which a touch occurs from detection outputs of said touch sensors of said plurality of operation keys.

17. The electronic apparatus according to claim 15, wherein a touch sensor for detecting a state of being touched with said user by a change in electrostatic capacity is formed on the surface of each of said plurality of operation keys, and said first detector unit detects said operation key at which a touch occurs from the detection output of said touch sensor.

18. The electronic apparatus according to claim 15, wherein said generator unit for generating a notification signal generates a display signal that displays an explanation message about said processing on a display screen as said notification signal.

19. The electronic apparatus according to claim 15, wherein said generator unit for generating a notification signal generates an audio signal of an explanation message about said processing as said notification signal.

20. The electronic apparatus according to claim 15, further comprising:

a determination unit for determining an operation key to be subjected to an operation of changing said state from an arrangement of a plurality of operation keys currently touched when said plurality of operation keys is currently touched.

21. The electronic apparatus according to claim 15, further comprising:

a discriminator unit for discriminating whether a process corresponding to said operation key recognized by said operation key recognizer unit is executable, wherein said generator unit for generating a notification signal notifies as an explanation of said process that said process corresponding to said operation key is not executable when said discriminator unit discriminates that said process is not executable.

22. The electronic apparatus according to claim 15, further comprising:

a second control unit for controlling a hardware module and/or a software module corresponding to said operation key recognized by said operation key recognizer unit when said key operation state recognizer unit recognizes that said operation key is touched.

23. An electronic apparatus, including:

an electronic apparatus body;

a first detector unit for detecting a touch at an operation key among a plurality of operation keys;

a second detector unit for detecting an operation key on which an operation of changing a state is performed;

a generator unit for generating a first remote-control signal including information for identifying said operation key at which a touch occurs based on a detection result of said first detector unit and information for indicating that said operation key is being touched;

a generator unit for generating a second remote-control signal which generates a second remote-control signal including information for identifying said operation key on which an operation of changing a state is performed based on a detection result of said second detector and information for indicating that the state of said operation key is changed; and a transmitter unit for transmitting said first remote-control signal and said second remote-control signal to said electronic apparatus body;

wherein the electronic apparatus body is configured to receive said remote-control signal from said transmitter and comprises:

a receiver unit for receiving said first remote-control signal and said second remote-control signal from said remote-control signal transmitter;

an operation key recognizer unit for recognizing information for identifying said operation key from said first remote-control signal or said second remote-control signal received by said receiver unit;

a key operation state recognizer unit for recognizing, from said first remote-control signal or said second remote-control signal received by said receiver unit, whether a state of an operation key recognized by said operation key recognizer unit is changed;

an identification unit for identifying a process that would be performed by the electronic apparatus body in response to a change in state of the operation key, wherein the identification unit identifies, in a case that the operation key recognized by the operation key recognizer unit from said first remote-control signal corresponds to a plurality of processes, a process that would be performed by the electronic apparatus body in response to a change in state of the operation key in an operating state in which the electronic apparatus body is operated when the operation key recognizer unit recognizes the operation key from said first remote-control signal, the electronic apparatus body being configured to perform a first process of the plurality of processes in response to a change in state of the operation key recognized from the first remote-control signal when the electronic apparatus body is in a first operating state and is configured to performed a second process of the plurality of processes in response to a change in state of the operation key recognized from the first remote-control signal when the electronic apparatus body is in a second operating state;

a generator unit for generating, in response to said key operation state recognizer unit recognizing that said operation key is touched, a notification signal for notifying a user about the process that would be performed in the operating state in response to a change in state of the operation key recognized by said operation key recognizer unit from said first remote-control signal; and a first control unit for controlling, in response to said key operation state recognizer unit recognizing that the state of said operation key is changed, a hardware module and/or a software module associated with said operation key recognized by said operation key recognizer unit from said second remote-control signal.

24. An electronic apparatus, comprising:

a plurality of operation keys;

a first detector unit for detecting a touch at an operation key among said plurality of operation keys;

a second detector unit for detecting an operation key on which an operation of changing a state is performed;

an identification unit for identifying a process that would be performed by the electronic apparatus in response to a change in state of the operation key, wherein the identification unit identifies, in a case that the operation key at which the touch is detected by the first detector unit corresponds to a plurality of processes, a process that would be performed by the electronic apparatus in response to a change in state of the operation key at a time that the touch at the operation key is detected, the electronic apparatus being configured to perform different processes of the plurality of processes in response to a change in state of the operation key detected to have been touched when the electronic apparatus is operated in different modes;

a generator unit for generating a notification signal notifying a user about the process that would be performed at the time in response to a change in state of said operation key at which a touch occurs based on a detection result of said first detector unit; and a first control unit for controlling a hardware module and/or a software module associated with said operation key on which an operation of changing a state is performed to a running state, based on a detection result of said second detector.

25. A method of controlling an electronic apparatus that includes a plurality of operation keys, a first detector unit, second detector, a generator unit for generating a notification signal, and a first control unit, comprising the steps of:

detecting a touch at an operation key among said plurality of operation keys;

detecting an operation key on which an operation of changing a state is performed;

identifying a process that would be performed by the electronic apparatus in response to a change in state of the operation key at which the touch is detected, wherein the operation key detecting to have been touched corresponds to a plurality of processes and the identifying comprises identifying a process of the plurality of processes that would be performed by the electronic apparatus in response to a change in state of the operation key at a time that the touch of the operation key is detected, the electronic apparatus being configured to perform a first process of the plurality of processes in response to a change in state of the operation key at which the touch is detected when the electronic apparatus is operated in a first mode and being configured to perform a second process of the plurality of processes in response to a change in state of the operation key at which the touch is detected when the electronic apparatus is operated in a second mode;

generating a notification signal for notifying a user of explanation about the process that would be performed at the time in response to a change in state of said operation key at which a touch occurs, based on a detection result of said detecting; and controlling a hardware module and/or a software module associated with said operation key on which an operation of changing a state is performed to a running state by said first control unit, based on a detection result of said detecting.

26. A method of controlling an electronic apparatus, where said electronic apparatus includes a remote-control signal transmitter having a plurality of operation keys, a first detector unit, a second detector, a generator unit for generating a first remote-control signal, a generator unit for generating a second remote-control signal, and a transmitter unit for transmitting a remote-control signal; and an electronic apparatus body, which receives said remote-control signal from said transmitter, including a receiver unit, an operation key recognizer unit, a key operation state recognizer unit, a generator unit for generating a notification signal, and a control unit, wherein the method comprising acts carried out by said transmitter comprising the steps of:

detecting a touch at an operation key among said plurality of operation keys;

detecting an operation key on which an operation of changing a state is performed;

generating a first remote-control signal containing information for identifying said operation key at which a touch occurs based on a detection result of said detecting and information for indicating that said operation key is being touched;

generating a second remote-control signal containing in information for identifying said operation key on which an operation of changing a state is performed based on the result of said detecting an operation key on which an operation of changing a state is performed; and transmitting said first remote-control signal and said second remote-control signal to said electronic apparatus body, and the method further comprises acts carried out by the electronic apparatus body of:

receiving said first remote-control signal and said second remote-control signal from said transmitter;

recognizing information for identifying said operation key from said first remote-control signal or said second remote-control signal received;

recognizing a key operation state for recognizing, from said first remote-control signal or said second remote-control signal received by said receiving whether a state of an operation key recognized by said operation key recognizing is changed;

identifying a process that would be performed by the electronic apparatus body in response to a change in state of the operation key, wherein the operation key detecting to have been touched corresponds to a plurality of processes and the identifying comprises identifying a process that would be performed by the electronic apparatus body in response to a change in state of the operation key at a time that the touch of the operation key is detected, the electronic apparatus body being configured to perform different processes of the plurality of processes in response to a change in state of the operation key at which the touch is detected when the electronic apparatus body is operated in different modes;

generating, in response to said key operation state recognizer unit recognizing that said operation key is touched, a notification signal for notifying a user of explanation about the process that would be performed at the time in response to a change in state of the operation key recognized by said operation key recognizing from said first remote-control signal; and controlling, in response to said recognizing of a key operation state recognizing that the state of said operation key is changed, a hardware module and/or a software module associated with said operation key recognized by said operation key recognizing from said second remote-control signal.

27. A computer storage apparatus having a program stored therein for receiving a remote-control signal in an electronic apparatus, wherein the electronic apparatus includes a first detector unit for detecting a touch at an operation key among a plurality of operation keys; a second detector unit for detecting an operation key on which an operation of changing a state is performed; a generator unit for generating a first remote-control signal containing information for identifying said operation key at which a touch occurs, based on a detection result of said first detector unit and information for indicating that said operation key is being touched; a generator unit for generating a second remote-control signal which generates a second remote-control signal including information for identifying said operation key on which an operation of changing a state is performed based on a detection result of said second detector and information for indicating that the state of said operation key is changed; and a transmitter unit for transmitting said first remote-control signal from said generator unit for generating a first remote-control signal and said second remote-control signal from said generator unit for generating a second remote-control signal to said electronic apparatus body, wherein to control said electronic apparatus in response to said remote-control signal from a remote-control transmitter, the program, when executed by a computer, causes the computer to function as:

an operation key recognizer unit for recognizing said operation key from said first remote-control signal or said second remote-control signal received by a receiver unit for receiving said first remote-control signal and said second remote-control signal from said transmitter;

a key operation state recognizer unit for recognizing, from said first remote-control signal or said second remote-control signal received by said receiver unit, whether a state of an operation key recognized by said operation key recognizer unit is changed;

an identification unit for identifying a process that would be performed by the electronic apparatus in response to a change in state of the operation key recognized by the operation key recognizer unit from said first remote-control signal, wherein the identification unit identifies, in a case that the operation key recognized by the operation key recognizer unit corresponds to a plurality of processes, a process that would be performed by the electronic apparatus in response to a change in state of the operation key at a time that the operation key recognizer unit recognizes the operation key from said first remote-control signal, the electronic apparatus being configured to perform different processes of the plurality of processes in response to a change in state of the operation key recognized from said first remote-control signal dependent on a mode in which the electronic apparatus is operating when a state of the operation key recognized from said first remote-control signal is changed;

a generator unit for generating, in response to said key operation state recognizer unit recognizing that said operation key is touched, a notification signal for notifying a user of explanation about the process that would be performed at the time in response to a change in state of the operation key recognized by said operation key recognizer unit from said first remote control signal; and a control unit for controlling, in response to said key operation state recognizer unit recognizing that the state of said operation key is changed, a hardware module and/or a software module associated with said operation key recognized by said operation key recognizer unit from said second remote control signal.

28. A computer storage apparatus having a program stored therein for an electronic apparatus, wherein in order to control said electronic apparatus in response to an operation input from a user to a plurality of operation keys, the program, when executed by a computer, causes the computer to function as:

a first detector unit for detecting a touch at an operation key among said plurality of operation keys;

second detector unit for detecting an operation key on which an operation of changing a state is performed;

an identification unit for identifying a process that would be performed by the electronic apparatus in response to a change in state of the operation key, wherein the identification unit identifies, in a case that the operation key at which the touch is detected by the first detector unit corresponds to a plurality of processes, a process that would be performed by the electronic apparatus in response to a change in state of the operation key at a time that the first detector unit detects the touch at the operation key, the electronic apparatus being configured to perform a first process of the plurality of processes in response to a change in state of the operation key at which the touch is detected when the electronic apparatus is operated in a first mode and being configured to perform a second process of the plurality of processes in response to a change in state of the operation key at which the touch is detected when the electronic apparatus is operated in a second mode;

a generator unit for generating a notification signal for notifying a user of explanation about the process that would be performed in response to a change of state of said operation key detected to be touched, based on a detection result of said first detector unit; and a control unit for controlling a hardware module and/or a software module associated with said operation key on which an operation of changing a state is performed to a running state is included, based on a detection result of said second detector.

* * * * *